US008390531B2

(12) United States Patent
Maruyama et al.

(10) Patent No.: US 8,390,531 B2
(45) Date of Patent: Mar. 5, 2013

(54) REFLECT ARRAY

(75) Inventors: Tamami Maruyama, Yokohama (JP); Shinji Uebayashi, Yokohama (JP); Tatsuo Furuno, Yokosuka (JP); Long Li, Shaanxi (CN); Qiang Chen, Sendai (JP); Qiaowei Yuan, Sendai (JP); Kunio Sawaya, Sendai (JP)

(73) Assignee: NTT DoCoMo, Inc., Tokyo (JP)

( * ) Notice: Subject to any disclaimer, the term of this patent is extended or adjusted under 35 U.S.C. 154(b) by 467 days.

(21) Appl. No.: 12/570,785

(22) Filed: Sep. 30, 2009

(65) Prior Publication Data

US 2010/0220036 A1 Sep. 2, 2010

(30) Foreign Application Priority Data

Sep. 30, 2008 (JP) ..... 2008-255590
Feb. 27, 2009 (JP) ..... 2009-046781
Aug. 26, 2009 (JP) ..... 2009-195820

(51) Int. Cl.
*H01Q 15/14* (2006.01)

(52) U.S. Cl. ..... 343/912

(58) Field of Classification Search ..... 343/912, 343/915, 700 MS, 797
See application file for complete search history.

(56) References Cited

U.S. PATENT DOCUMENTS

| | | | | |
|---|---|---|---|---|
| 6,759,994 | B2 * | 7/2004 | Rao et al. | 343/912 |
| 6,930,653 | B2 * | 8/2005 | Rawnick et al. | 343/912 |
| 2002/0101391 | A1 * | 8/2002 | Kanamaluru et al. | 343/915 |
| 2004/0189545 | A1 * | 9/2004 | Bekey | 343/912 |
| 2005/0057412 | A1 * | 3/2005 | Hwang et al. | 343/767 |
| 2005/0195120 | A1 * | 9/2005 | Rawnick et al. | 343/840 |
| 2009/0146907 | A1 * | 6/2009 | Brown | 343/912 |
| 2010/0085272 | A1 * | 4/2010 | Legay et al. | 343/913 |

FOREIGN PATENT DOCUMENTS

| | | |
|---|---|---|
| JP | 05-191136 | 7/1993 |
| JP | 8-288901 | 11/1996 |
| JP | 2001-111333 | 4/2001 |
| JP | 2002-76670 | 3/2002 |
| JP | 2004-505582 | 2/2004 |
| WO | WO 02/11238 A1 | 2/2002 |

OTHER PUBLICATIONS

Japanese Office Action mailed Jul. 31, 2012 in Japanese Patent Application No. 2009-195820 (with English translation).

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

A reflect array (1) according to the present invention includes a plurality of array elements (10) forming an array configured to control a direction of a reflected wave (scattered wave) by controlling a phase of the reflected wave; and a ground plane (30). The ground plane (30) has a structure with a frequency selective function.

18 Claims, 27 Drawing Sheets

| NUMBER | SIZE (mm) | PHASE (deg) |
|---|---|---|
| 1 | 9.95 | -143.20 |
| 2 | 9.32 | -61.98 |
| 3 | 9.14 | 17.05 |
| 4 | 9.00 | 86.18 |
| 5 | 8.56 | 151.40 |
| 6 | 9.03 | 74.16 |
| 7 | 8.57 | 151.39 |
| 8 | 9.61 | -125.42 |
| 9 | 9.32 | -61.98 |
| 10 | 9.17 | 6.01 |
| 11 | 9.35 | -78.32 |
| 12 | 9.17 | 6.01 |
| 13 | 9.00 | 86.18 |
| 14 | 8.50 | 155.00 |
| 15 | 9.72 | -133.65 |

FIG. 12

| NUMBER | LENGTH OF CROSSED DIPOLE(mm) | WIDTH OF CROSSED DIPOLE (mm) |
|---|---|---|
| 1 | 1.462 | 0.5 |
| 2 | 4.626 | 0.5 |
| 3 | 3.304 | 0.5 |
| 4 | 1.947 | 0.5 |
| 5 | 4.974 | 0.5 |
| 6 | 6.484 | 0.5 |
| 7 | 3.670 | 0.5 |
| 8 | 2.716 | 0.5 |
| 9 | 6.800 | 0.5 |
| 10 | 3.792 | 0.5 |
| 11 | 4.199 | 0.5 |
| 12 | 3.124 | 0.5 |
| 13 | 1.500 | 0.5 |
| 14 | 4.399 | 0.5 |
| 15 | 3.233 | 0.5 |

CASE OF TE INCIDENCE

CASE OF TM INCIDENCE

TM-polarized incidence

TE-polarized incidence

FIG. 16

| NUMBER | LENGTH OF CROSSED DIPOLE (mm) | WIDTH OF CROSSED DIPOLE (mm) |
|---|---|---|
| 1 | 4.142 | 0.5 |
| 2 | 6.000 | 0.5 |
| 3 | 2.716 | 0.5 |
| 4 | 3.540 | 0.5 |
| 5 | 5.127 | 0.5 |
| 6 | 4.142 | 0.5 |
| 7 | 6.000 | 0.5 |
| 8 | 2.716 | 0.5 |
| 9 | 3.540 | 0.5 |
| 10 | 5.127 | 0.5 |
| 11 | 4.142 | 0.5 |
| 12 | 6.000 | 0.5 |
| 13 | 2.716 | 0.5 |
| 14 | 3.540 | 0.5 |
| 15 | 5.127 | 0.5 |

Ey-POLARIZED WAVE

Ex-POLARIZED WAVE

BACK SURFACE

FRONT SURFACE

FIG. 19

| NUMBER | LENGTH OF CROSSED DIPOLE (mm) | WIDTH OF CROSSED DIPOLE (mm) |
|---|---|---|
| 1 | 1.664 | 0.5 |
| 2 | 4.445 | 0.5 |
| 3 | 3.805 | 0.5 |
| 4 | 2.603 | 0.5 |
| 5 | 4.597 | 0.5 |
| 6 | 5.622 | 0.5 |
| 7 | 4.002 | 0.5 |
| 8 | 3.414 | 0.5 |
| 9 | 6.800 | 0.5 |
| 10 | 4.064 | 0.5 |
| 11 | 4.255 | 0.5 |
| 12 | 3.702 | 0.5 |
| 13 | 1.000 | 0.5 |
| 14 | 4.358 | 0.5 |
| 15 | 3.761 | 0.5 |

FIG. 22

Dimension : 11 by 7, L = 77mm, W = 49mm @ 24GHz (Unit : mm)

| LENGTH OF CROSSED DIPOLE | 1 | 2 | 3 | 4 | 5 | 6 | 7 | 8 | 9 | 10 | 11 |
|---|---|---|---|---|---|---|---|---|---|---|---|
| 1 | 2.616 | 6.8 | 4.016 | 3.138 | 1.783 | 5.338 | 3.585 | 2.762 | 0.6 | 4.218 | 3.255 |
| 2 | 0.6 | 4.601 | 3.384 | 2.465 | 6.8 | 3.889 | 3.047 | 1.240 | 4.912 | 3.488 | 2.650 |
| 3 | 5.588 | 3.638 | 2.823 | 0.6 | 4.324 | 3.304 | 2.273 | 6.296 | 3.771 | 2.960 | 0.6 |
| 4 | 3.954 | 3.093 | 1.630 | 5.127 | 3.540 | 2.716 | 6.8 | 4.143 | 3.216 | 2.034 | 5.718 |
| 5 | 3.346 | 2.388 | 6.585 | 3.833 | 3.007 | 0.756 | 4.772 | 3.451 | 2.591 | 6.8 | 3.988 |
| 6 | 2.769 | 0.6 | 4.234 | 3.263 | 2.168 | 6.045 | 3.721 | 2.921 | 0.6 | 4.397 | 3.367 |
| 7 | 1.271 | 4.934 | 3.495 | 2.661 | 6.8 | 4.069 | 3.173 | 1.895 | 5.496 | 3.618 | 2.796 |

Reflectarray Board No. 7 Measurement

Two independent measurements :

Cause1 : Source 1 at yoz plane excited ($\theta_{i1}$, $\phi_{i1}$) = (20°, -90°)

Cause2 : Source 2 at xoz plane excited ($\theta_{i2}$, $\phi_{i2}$) = (30°, -180°)

Parameter

| Inc. angle | ($\theta_{i1}$, $\phi_{i1}$) = (20°, -90°) | ($\theta_{i2}$, $\phi_{i2}$) = (30°, -180°) |
|---|---|---|
| Polarization | x-pol. | y-pol. |
| Ref. angle | ($\theta_{r1}$, $\phi_{r1}$) = (40°, 0°) | ($\theta_{r2}$, $\phi_{r2}$) = (0°, 0°) |
| Frequency | 12GHz | 12GHz |

| ELEMENT NUMBER | X-DIRECTION LENGTH [mm] | Y-DIRECTION LENGTH [mm] | ELEMENT NUMBER | X-DIRECTION LENGTH [mm] | Y-DIRECTION LENGTH [mm] |
|---|---|---|---|---|---|
| 1 | 13.8 | 7.33 | 12 | 9.56 | 7.33 |
| 2 | 5.66 | 5.46 | 13 | 3.27 | 5.46 |
| 3 | 8.46 | 2 | 14 | 6.83 | 2 |
| 4 | 9.41 | 9.47 | 15 | 12.32 | 9.47 |
| 5 | 6.36 | 6.76 | 16 | 4.9 | 6.76 |
| 6 | 10.21 | 4.75 | 17 | 7.59 | 4.75 |
| 7 | 3.89 | 13.6 | 18 | 13.8 | 13.6 |
| 8 | 7.03 | 8.31 | 19 | 5.75 | 8.31 |
| 9 | 13.22 | 6.25 | 20 | 8.62 | 6.24 |
| 10 | 5.15 | 3.39 | 21 | 4.63 | 3.39 |
| 11 | 7.82 | 12.34 | 22 | 6.45 | 12.34 |

| Frequency | 6GHz | 12GHz |
|---|---|---|
| Polarization | x-pol. | y-pol. |
| Inc.angle ($\theta_i, \phi_i$) | 0°, 0° | 0°, 90° |
| Ref.angle ($\theta_r, \phi_r$) | 30°, 0° | 30°, 90 |

(a) FAR SCATTERING FIELD (6GHz)

(b) FAR SCATTERING FIELD (12GHz)

REFLECT ARRAY

BACKGROUND OF THE INVENTION

1. Field of the Invention

The present invention relates to a reflect array.

The present invention particularly relates to a polarization sharing reflect array and a frequency selective surface reflect array, including (1) a technique of scattering a TE (Transverse Electric) wave incident on a reflector in a direction different from that of regular reflection (specular reflection), (2) a technique of scattering both of a TE incident wave and a TM (Transverse Magnetic) incident wave in the same desired direction, (3) a technique of reflecting the waves only at a desired frequency and transmitting the waves at other frequencies, and (4) a technique which can direct a beam to a desired direction for an incident wave from any direction.

In addition, the present invention relates to a polarization independent control reflect array configured to receive a horizontally-polarized wave and a vertically-polarized wave incident from independently determined directions, and to scatter each of the polarized waves in a desired direction that can be independently determined.

Moreover, the present invention relates to a frequency sharing polarization independent control reflect array configured to perform control by causing array elements to act on horizontally-polarized and vertically-polarized waves coming in at different frequencies.

Moreover, the present invention relates to a reflect array which does not affect other systems, since the reflect array operates as if being invisible to electric waves at frequencies other than a desired frequency and thus transmits the waves.

Furthermore, the present invention relates to a reflect array used in a system configured to independently control two polarized waves: a horizontally-polarized wave and a vertically-polarized wave, such as polarization control MIMO, polarization diversity and sharing of broadcasting and communication.

2. Description of the Related Art

An example of a conventional reflect array is shown in F. Venneri, G. Angiulli and G. Di Massa, "Design of micro-strip reflect array using data from isolated", IEEE Microwave and Optical Technology Letters, Vol. 34, No. 6, Sep. 20, 2002 (Non-patent Document 1). In the reflect array, as shown in FIG. 1, a shape of a micro-strip antenna is set as an array element and a metal flat plate is used as a ground plane. Moreover, dimensions "a" and "b" of the array element are determined by a phase difference as shown in FIG. 2.

However, the conventional reflect array as shown in FIGS. 1 and 2 has the following drawback because of the metal flat plate used as a back surface thereof. Specifically, electric waves at frequencies other than a desired frequency cannot be transmitted, polarized waves of a TM wave and a TE wave cannot be shared, and electric waves coming in from any direction cannot be radiated in a desired direction.

Moreover, the reflect array has the following drawback. Specifically, electric waves at frequencies other than a desired frequency cannot be transmitted, since the metal flat plate is used as the back surface thereof.

Furthermore, polarized waves independently incident from any directions cannot be radiated to any previously separately determined directions, since the reflect array does not even have a function of independently controlling horizontally-polarized and vertically-polarized waves.

Moreover, an example of a conventional frequency selective surface is shown in Junji Asada, "A Fundamental Study of Radar Absorber with Frequency Selective Surface", Journal of Institute of Electronics, Information and Communication Engineers, Vol. J90-B No. 1, pp. 56-62, 2007. The frequency selective surface uses crossed dipoles as elements for a periodic structure to impart frequency selectivity.

Furthermore, the frequency selective surface has a drawback that a beam cannot be bent and scattered in a desired direction due to the absence of a structure to give a phase difference.

It is hard for the conventional reflect array and frequency selective surface to simultaneously realize any two or more of the following functions.

(1) Function of radiating a wave in a direction different from that of specular reflection.

(2) Function of radiating a TE incident wave and a TM incident wave both in the same desired direction.

(3) Function of reflecting waves at a desired frequency and to transmit waves at other frequencies.

(4) Function of directing a beam to a desired direction for an incident wave from any direction.

Moreover, the conventional reflect array is used as a reflector of a reflector antenna as described in the Non-patent Document 1, and a direction of arrival and polarization of an incident wave are determined by a primary radiator and thus are assumed to be previously known.

Therefore, no consideration has been given to a technique of scattering multi-path signals in a desired direction when the multi-path signals are incident on a reflector from any direction with any polarized wave by rotation in an outdoor propagation environment as described in Japanese Patent Application No. 2007-311649.

In addition, the conventional metal reflector only reflects incident waves, which come in as different polarized waves of horizontally-polarized and vertically-polarized waves, to a specular reflection direction, and does not have a function of independently controlling the polarized waves.

Moreover, the conventional reflect array and frequency selective surface do not have a function of independently controlling multiple polarized waves.

Furthermore, the reflect array does not have a frequency sharing polarization independent control function of independently controlling horizontally-polarized and vertically-polarized waves coming in at two different frequencies.

SUMMARY OF THE INVENTION

The present invention has been made in consideration of the foregoing problems. It is an object of the present invention to provide a reflect array capable of realizing the following points.

(1) To scatter electric waves scattered from a reflector in a desired direction different from that of specular reflection at a desired frequency and to transmit the electric waves at other frequencies.

(2) To reflect electric waves scattered from the reflect array in a desired direction in both cases of TE wave incidence and TM wave incidence.

(3) To activate a function of tilting a scattering direction of the reflect array for incidence from any direction.

(4) To cause scattering having the functions (2) and (3) at a desired frequency and to transmit electric waves at other frequencies.

Moreover, the present invention has been made in consideration of the foregoing problems. It is an object of the present invention to provide a reflect array capable of realizing the following points.

(5) To control a radiation direction in independently different directions for independent incidence of two different polarized waves of a horizontally-polarized wave and a vertically-polarized wave.

(6) To control a radiation direction in independently different directions for horizontally-polarized and vertically-polarized waves incident at multiple different frequencies.

A first aspect of the present invention is summarized as a reflect array including: a plurality of array elements forming an array configured to control a direction of a reflected wave (scattered wave) by controlling a phase of the reflected wave; and a ground plane, wherein the ground plane has a structure with a frequency selective function.

A second aspect of the present invention is summarized as a reflect array including: a plurality of array elements forming an array configured to control a direction of a reflected wave (scattered wave) by controlling a phase of the reflected wave; and a ground plane, wherein the array elements have a structure for aligning phases for a TE incident wave and a structure for aligning phases for a TM incident wave.

A third aspect of the present invention is summarized as a reflect array including: a plurality of array elements forming an array configured to control a direction of a reflected wave (scattered wave) by controlling a phase of the reflected wave; and a ground plane, wherein the array elements are polarization sharing elements and have a function capable of being shared and used for incident waves coming in as both horizontally-polarized and vertically-polarized waves.

In the second and third aspects, the reflect array can have a frequency selective structure.

In the second and third aspects, each array element can be formed of a crossed dipole having a horizontal rod and a vertical rod; horizontal and vertical dimensions of the crossed dipole can be different for each array element; and for both a TE incident wave and a TM incident wave, any one of the horizontal and vertical rods can be operated to control the phase of the reflected wave, thereby controlling the direction of the reflected wave for both of a TE wave and a TM wave simultaneously.

In the first to third aspects, the frequency selective structure can have periodic structure loops.

In the first to third aspects, the frequency selective structure can be configured to reflect (scatter) electric waves at a selective frequency, and to transmit electric waves at frequencies other than the selective frequency.

In the first to third aspects, the reflect array can have a structure which enables the reflected wave to be tilted in a desired direction, by giving a phase difference between X direction and Y direction, for incidence from the X direction and incidence from the Y direction.

In the first to third aspects, each periodic structure loop can have a desired frequency of $1\lambda$; and a pitch between the periodic structure loops can be within a range between $0.4\lambda$ and $0.6\lambda$.

In the first to third aspects, each array element can be formed so as to have the same structure and the same size when seen from the horizontal direction and the vertical direction.

In the first to third aspects, the ground plane can be formed so as to have the same structure and the same size when seen from the horizontal direction and the vertical direction.

A fourth aspect of the present invention is summarized as a reflect array including: a plurality of array elements; and a ground plane, wherein each array element is formed of a crossed dipole having a horizontal rod and a vertical rod; and when an incidence direction of a vertically-polarized wave and an incidence direction of a horizontally-polarized wave are different from each other, the vertical rods are operated for the incidence of the vertically-polarized wave so that a reflected wave (scattered wave) is radiated in a direction determined by a phase of a current distribution of each vertical rod, and the horizontal rods are operated for the incidence of the horizontally-polarized wave so that a reflected wave (scattered wave) is radiated in a direction determined by a phase of a current distribution of each horizontal rod, thereby independently determining a radiation direction of the reflected wave of the vertically-polarized wave and a radiation direction of the reflected wave of the horizontally-polarized wave.

In the fourth aspect, an operating frequency of the horizontal rod and an operating frequency of the vertical rod can be different from each other.

In the fourth aspect, the ground plane can be formed of a frequency selective surface.

In the fourth aspect, the frequency selective surface can be formed of a loop array.

In the fourth aspect, the ground plane can be formed of a two-frequency-sharing frequency selective surface.

In the fourth aspect, the ground plane can be formed of a broadband frequency selective surface.

As described above, the present invention can provide a reflect array capable of realizing the following points.

(1) To scatter electric waves scattered from a reflector in a desired direction different from that of specular reflection at a desired frequency and to transmit the electric waves at other frequencies.

(2) To reflect electric waves scattered from the reflect array in a desired direction in both cases of TE wave incidence and TM wave incidence.

(3) To activate a function of tilting a scattering direction of the reflect array for incidence from any direction.

(4) To cause scattering having the functions (2) and (3) at a desired frequency and to transmit electric waves at other frequencies.

Moreover, the present invention can provide a reflect array capable of realizing the following points.

(5) To control a radiation direction in independently different directions for independent incidence of two different polarized waves of a horizontally-polarized wave and a vertically-polarized wave.

(6) To control a radiation direction in independently different directions for horizontally-polarized and vertically-polarized waves incident at multiple different frequencies.

Moreover, the reflect array according to the present invention can be applied, by using the functions (5) and (6), to capacity increase by polarization sharing MIMO and a system using polarization diversity.

BRIEF DESCRIPTION OF THE DRAWINGS

FIG. 12 is a table showing lengths and widths of crossed dipoles in the reflect array according to the first embodiment of the present invention.

FIG. 16 is a table showing lengths and widths of crossed dipoles in the reflect array according to the second embodiment of the present invention.

FIG. 19 is a table showing lengths and widths of crossed dipoles in the reflect array according to the third embodiment of the present invention.

FIG. 22 is a table showing lengths and widths of crossed dipoles in the reflect array according to the fourth embodiment of the present invention.

DESCRIPTION OF THE EMBODIMENTS

With reference to the drawings, embodiments of the present invention will be described in detail below.

First Embodiment of the Invention

Figures 1, 2:
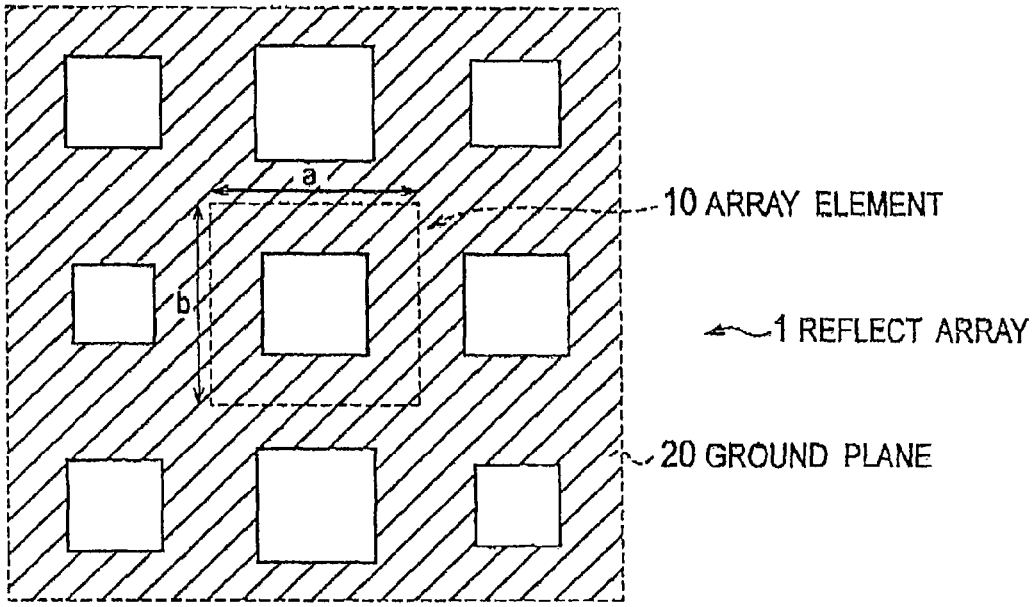
FIG. 1 is a view showing a conventional micro-strip reflect array.
FIG. 2 is a table showing a relationship between a phase and a size of an array element in the conventional reflect array shown in FIG. 1.
Figure 3:
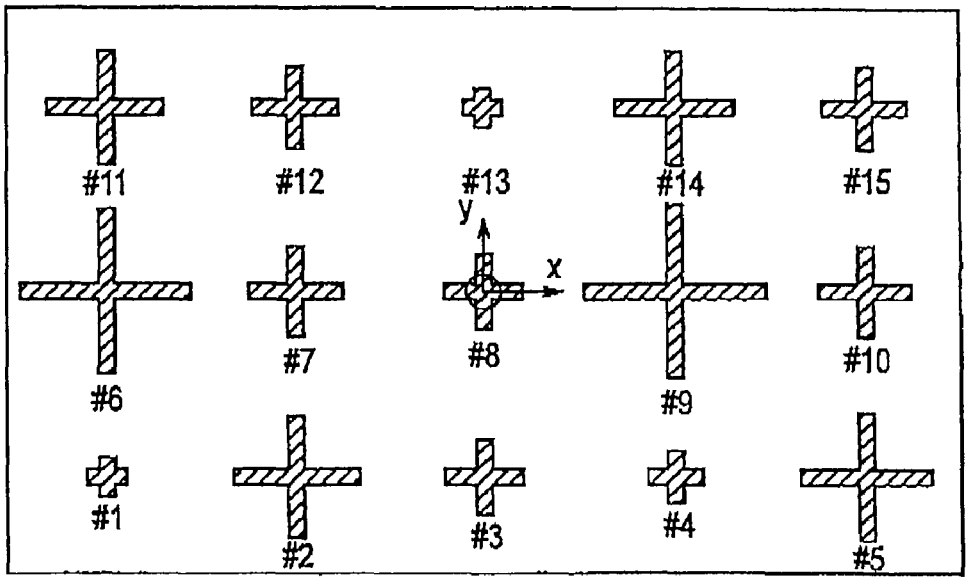
FIG. 3 is a view showing a frequency selective reflect array according to a first embodiment of the present invention.
Figure 4:
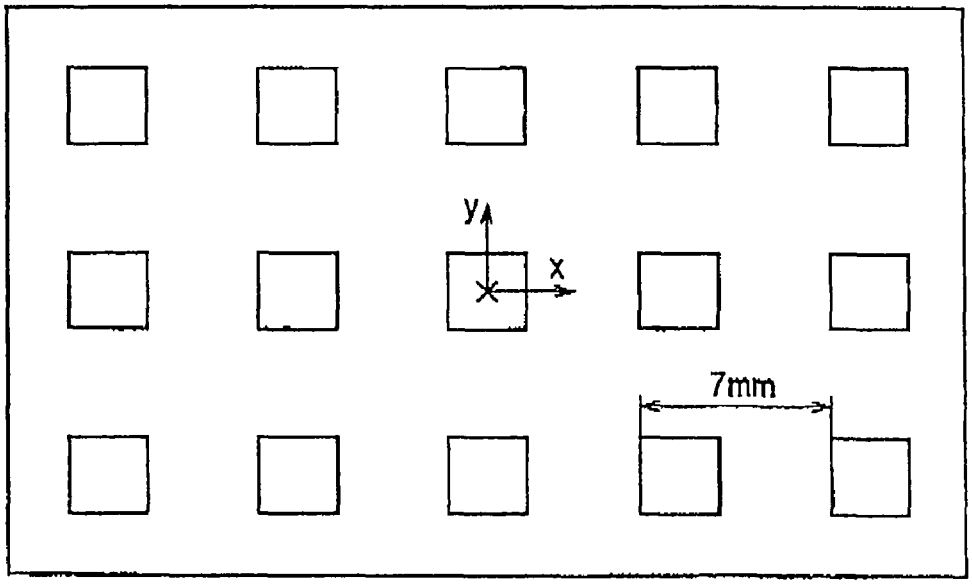
FIG. 4 is a view showing the frequency selective reflect array according to the first embodiment of the present invention.
Figure 5:
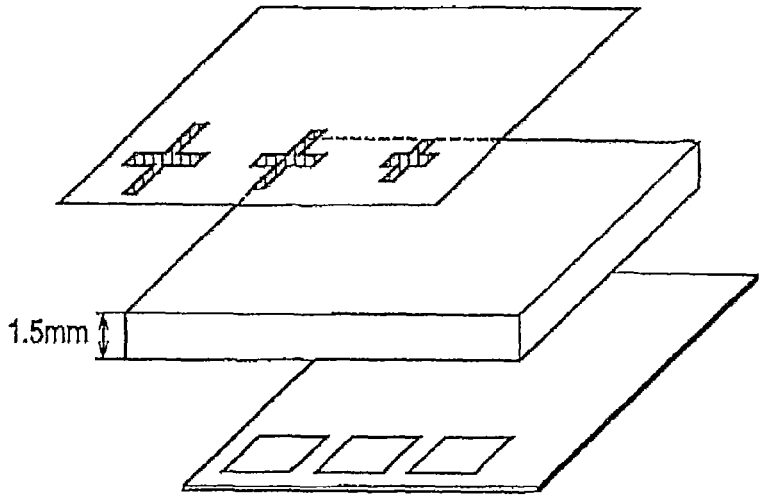
FIG. 5 is a view showing the reflect array according to the first embodiment of the present invention.

FIGS. 3 to 5 show a frequency selective reflect array according to a first embodiment of the present invention. In the frequency selective reflect array according to this embodiment, crossed dipole array elements are arranged on a front surface of a dielectric substrate as shown in FIGS. 3 and 5, and loop array elements are arranged on a back surface thereof as shown in FIGS. 4 and 5.

Here, in the frequency selective reflect array shown in FIGS. 3 to 5, the crossed dipoles on the front surface vary in length so that a phase difference between reflected waves may be aligned with a desired direction of departure.

Moreover, in the frequency selective reflect array, each of the loops on the back surface is set to have a length at which a reflection coefficient is 0 dB, by performing an electromagnetic field simulation taking into consideration permittivity of the dielectric substrate and a loop width. The length is about one wavelength of an operating frequency.

Figure 6:
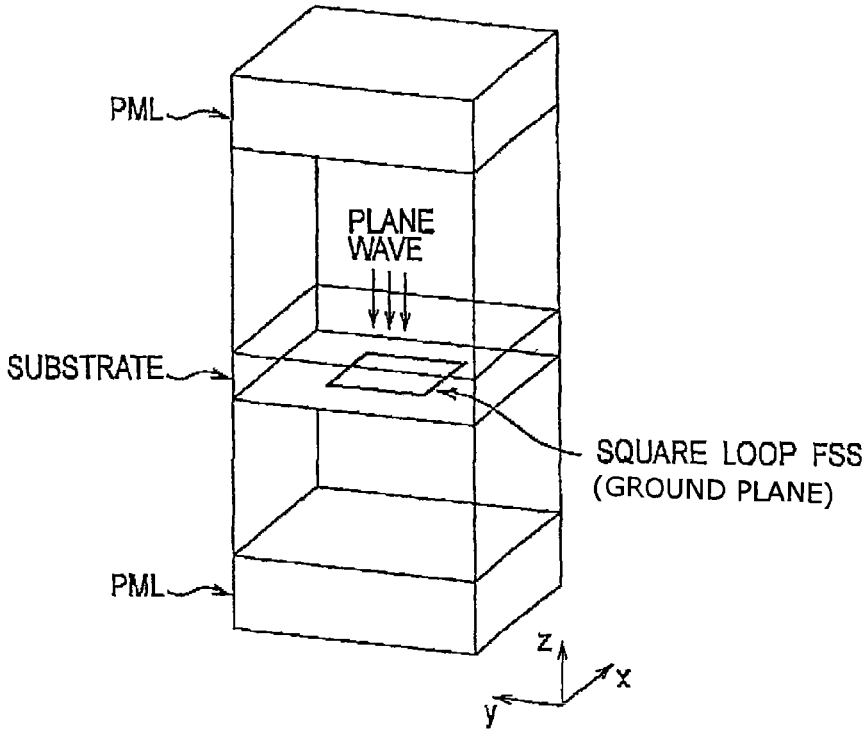
FIG. 6 is a view for explaining characteristics of a reflection coefficient and a transmission coefficient in a square-loop FSS disposed in the reflect array according to the first embodiment of the present invention.
Figure 7:
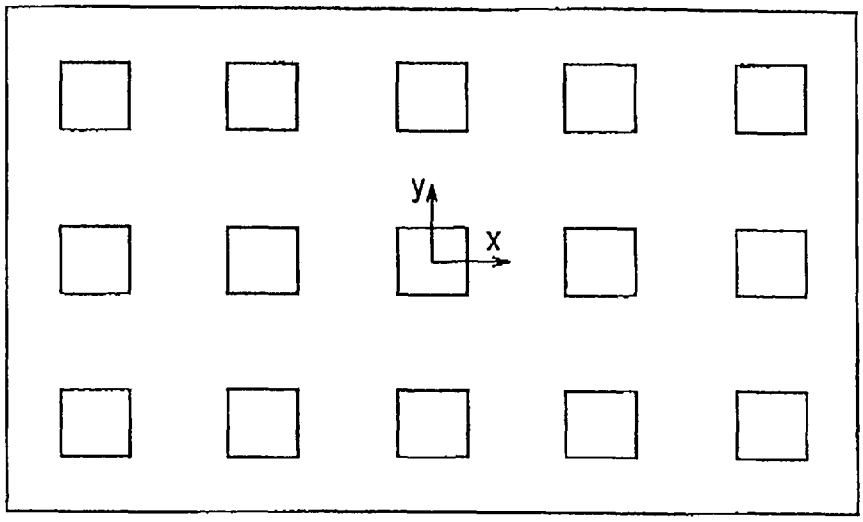
FIG. 7 is a view for explaining the characteristics of the reflection coefficient and the transmission coefficient in the square-loop FSS disposed in the reflect array according to the first embodiment of the present invention.
Figure 8:
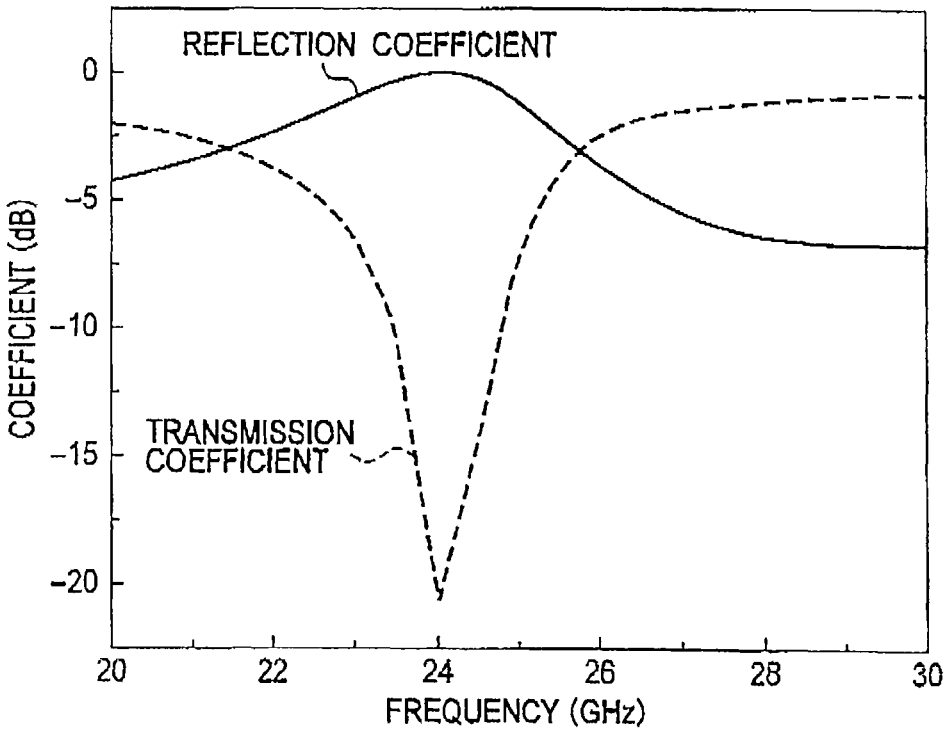
FIG. 8 is a view for explaining the characteristics of the reflection coefficient and the transmission coefficient in the square-loop FSS disposed in the reflect array according to the first embodiment of the present invention.

First, description will be given of frequency selectivity of square loops arranged on the back surface to operate as a ground plane. FIGS. 6 and 7 are views showing an analysis model when a plane wave is applied from above the square loop (positive direction of Z-axis). FIG. 8 is a graph showing characteristics of a reflection coefficient and a transmission coefficient.

Here, as a structure of the square loops, a peripheral length is 12 mm, a thickness of the substrate is 1.5 mm and a pitch D between the square loops is 7 mm. For the analysis, periodic boundary conditions are used and it is assumed that the square loop has an infinite period.

As is clear from FIG. 8, the reflection coefficient reaches 0 dB at 24 GHz, resulting in total reflection. On the other hand, the transmission coefficient approaches 0 dB at other frequencies. In other words, it can be confirmed that the reflection coefficient has frequency selectivity for the periodic structure of the square loop.

Next, examination will be made on the reflection coefficient when the crossed dipole is provided above the square loop shown in FIGS. 6 and 7.

Figure 9:
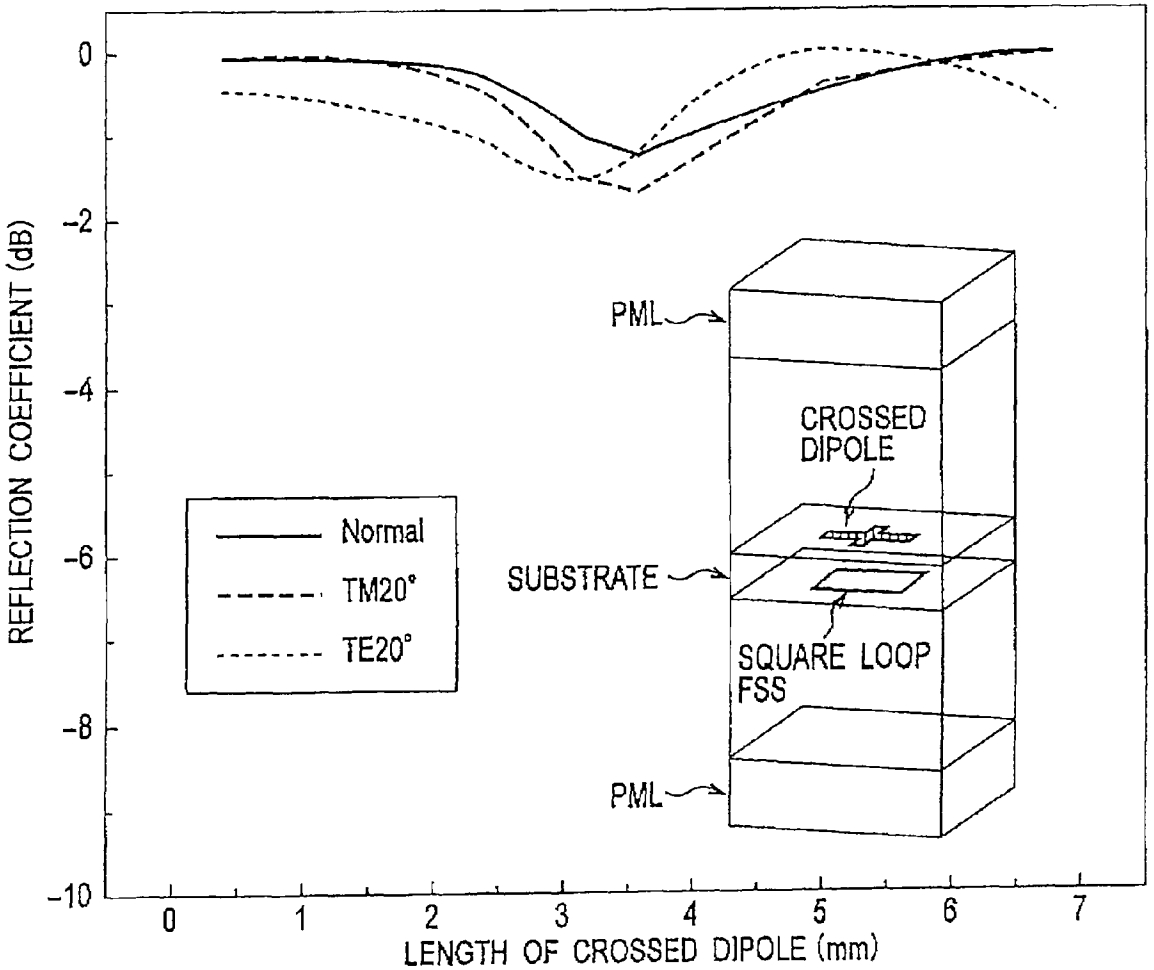
FIG. 9 is a graph showing changes in the reflection coefficient in relation to a length of a 24 GHz crossed dipole disposed in the reflect array according to the first embodiment of the present invention.

FIG. 9 shows an analysis model and a graph of reflection coefficients when the crossed dipole is provided above the square loop.

Specifically, FIG. 9 shows reflection coefficients, in relation to varied lengths of the crossed dipole, when an incident wave is applied from a normal direction of a reflector, when a TM wave is incident while being inclined at an angle of 20° by changing a direction of a field on a plane perpendicular to a traveling direction, and when a TE wave is incident while being inclined at an angle of 20° by changing the direction of the field on the plane perpendicular to the traveling direction.

An amount of change in the reflection coefficient when the length of the crossed dipole is changed from 0.5 mm (0.04λ at 24 GHz) to 6.5 mm (0.52λ at 24 GHz) is only 2 dB or less, which is considered to be smaller than that in the case where the reflection coefficient has frequency selectivity for the square loop having the periodic structure.

This shows that a selective frequency of the structure in which the square loops are arranged on the back surface of the frequency selective reflect array according to this embodiment and the crossed dipoles are arranged on the front surface thereof can be approximately determined by the shape and size of the square loops on the back surface.

Note that, here, the crossed dipole has a symmetrical structure with the same length in X and Y directions. Therefore, the reflection coefficient in the case of incidence from the normal direction has approximately the same value in either case of TE incidence and TM incidence.

Figure 10:
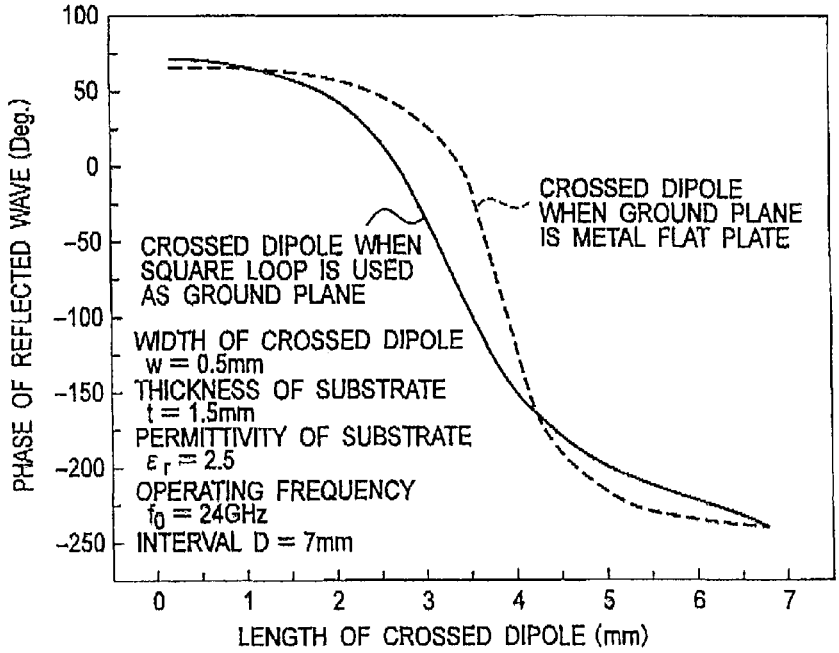
FIG. 10 is a graph showing a phase variation of a reflected wave of the crossed dipole when a ground plane is a metal flat plate and a phase variation of a reflected wave of the crossed dipole when the ground plane is the square-loop FSS, in the reflect array according to the first embodiment of the present invention.

Next, FIG. 10 shows phase variations when the length of the crossed dipole in the frequency selective reflect array according to this embodiment is changed from 0.5 mm (0.04λ at 24 GHz) to 6.5 mm (0.52λ at 24 GHz) as in the case of FIG. 9. The length and width of the crossed dipole used in this event are as shown in FIG. 12.

In FIG. 10, a solid line shows a change in a reflection phase of the crossed dipole when the square loop is used as the ground plane, and a broken line shows, for comparison, a change in the reflection phase of the crossed dipole when the ground plane is a metal flat plate.

It is clear from FIG. 10 that the phase of the reflected wave can be changed by changing the length of the crossed dipole. It is also clear from FIGS. 9 and 10 that the reflector can determine the selective frequency based on the peripheral length of the loop and can change the phase of the reflected wave based on the length of the crossed dipole.

Next, description will be given of a method for directing the reflected wave to a desired direction by use of the reflector. A reflect array design technique is of designing the array elements so as to scatter (reflect) the incident wave with a required phase difference for directing a beam to a desired direction.

Figure 11:
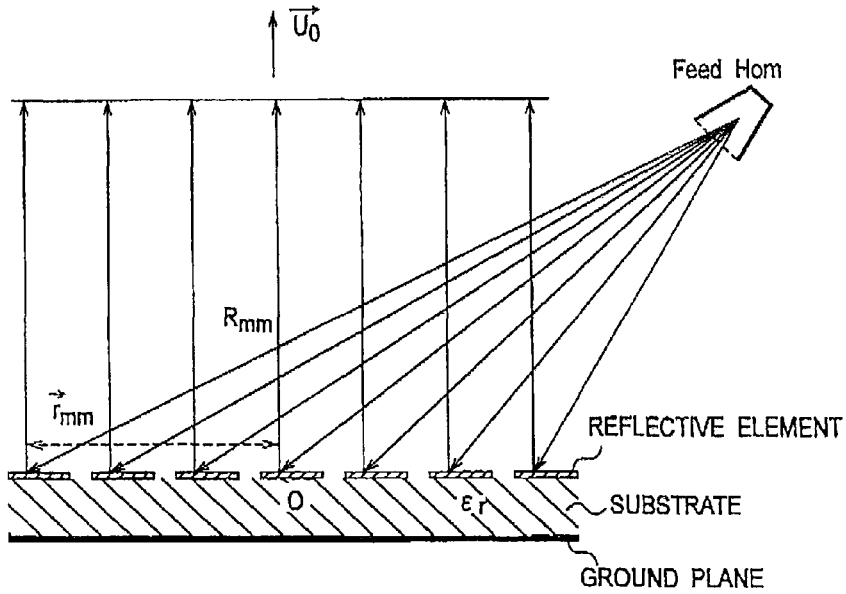
FIG. 11 is a view showing a structure of a micro-strip reflect array according to the first embodiment of the present invention.

To explain this technique, FIG. 11 shows principles of a reflect array having a standard printed array as an element. The following (Formula 1) expresses an array aperture distribution condition for aligning phases in a desired direction.

$$\phi_{mn}-K_0(R_{mn}+\vec{r}_{mn}\cdot\vec{U}_0)=2\rho\pi,\rho=\pm1,\pm2| \quad \text{(Formula 1)}$$

Here, in (Formula 1), $R_{mn}$ is a distance from a wave source to an $mn^{th}$ element, and $\Phi_{mn}$ is a phase of a scattering field from the $mn^{th}$ element.

In addition, the following term is a position vector from the array center to the $mn^{th}$ element.

$$\vec{r}_{mn}$$

Moreover, the following term is a unit vector with respect to a direction of a main beam of the reflect array.

$$\vec{U}_0|$$

While the ground plane is the metal flat plate in the conventional micro-strip reflect array, the ground plane is formed of the loop having the periodic structure in the micro-strip reflect array according to the first embodiment of the present invention. However, the same design method is employed for both of the reflect arrays.

In designing of the micro-strip reflect array, generally, shapes and sizes of reflective elements are changed to obtain a required phase.

In the first embodiment of the present invention, lengths that satisfy (Formula 1) are determined, respectively, from the graph of FIG. 10 showing the phase and the element length of the crossed dipole.

In the example of the reflect array according to this embodiment shown in FIGS. 3 to 5, the reflect array is designed so as to scatter the wave inclined at 35° to the X-axis direction at 24 GHz. FIG. 12 shows lengths of the crossed dipoles #1 to #15 in FIG. 3, which are obtained so as to correspond to FIG. 10.

Figure 13B:
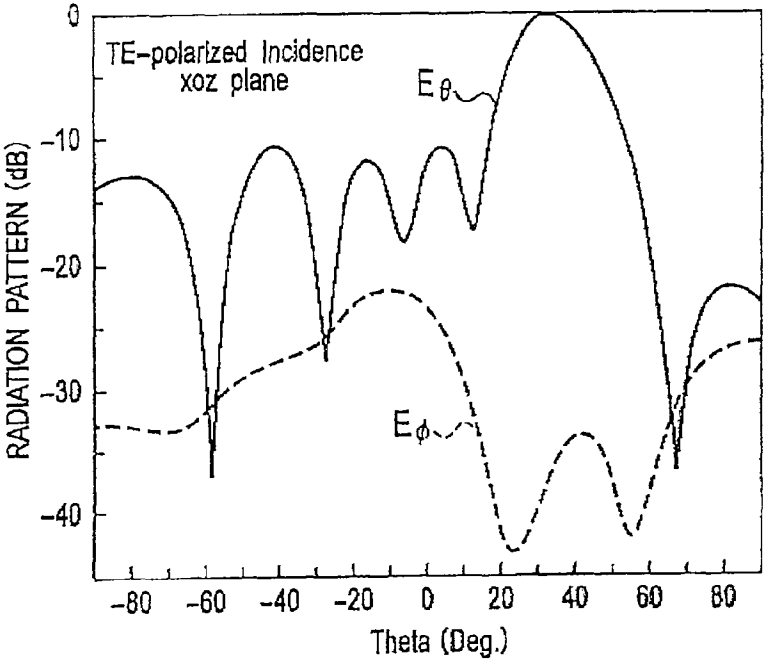
FIGS. 13A and 13B are views showing a radiation pattern (XZ plane) of the crossed dipole in the frequency selective reflect array according to the first embodiment of the present invention.
Figure 13A:
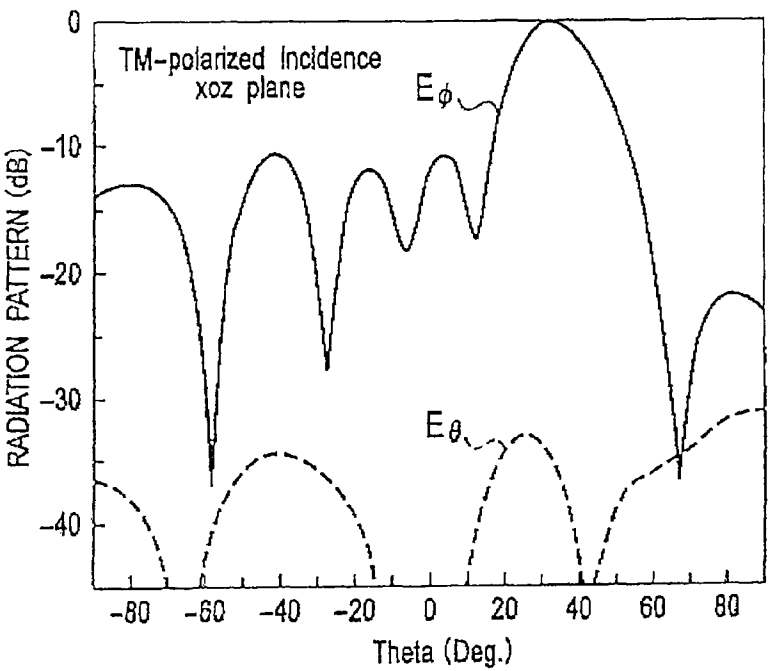

Next, to see the effect of the present invention, FIGS. 13A and 13B shows a far scattering field of the crossed dipole in the reflect array according to this embodiment.

Although it is assumed here that the wave source comes from $(\theta_i, \Phi_i)=(20°, -90°)$, the wave source can come from anywhere when the beam is bent at 40° or less in the case of the present invention. In the case of the present invention, since the crossed dipole is employed, the wave source may be either the TM wave or the TE wave.

FIG. 13A shows a radiation pattern in the case of the TM wave incidence, and FIG. 13B shows a radiation pattern in the case of the TE wave incidence. It is clear that, in either case, the waves are radiated at 35°, which is the desired direction.

Next, with reference to FIGS. 14A and 14B, description will be given of an effect for the frequency selectivity in this embodiment.

Figure 14A:
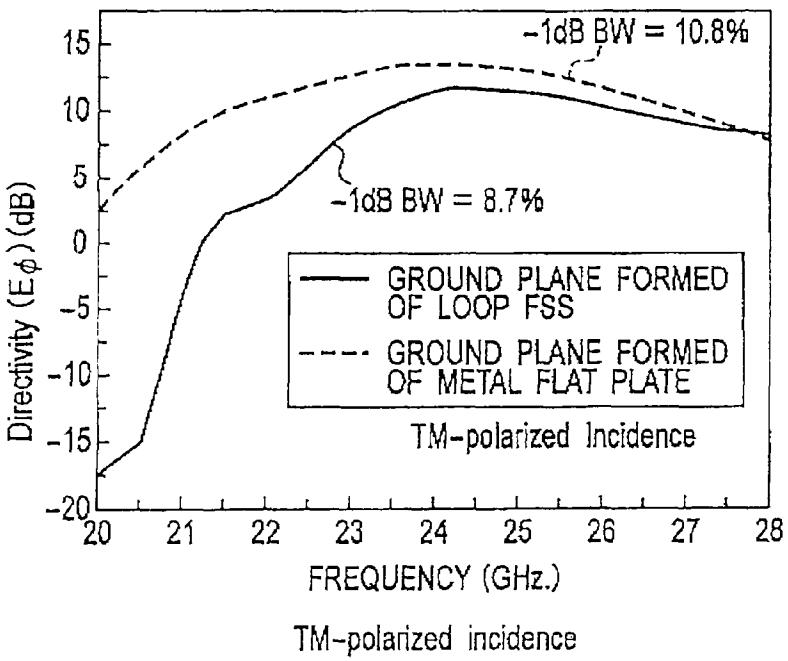
FIGS. 14A and 14B are graphs for comparing a gain in a desired direction (35° direction) in the conventional reflect array using a metal flat plate as a ground plane with a gain in a desired direction (35° direction) in the reflect array according to the first embodiment of the present invention.
Figure 14B:
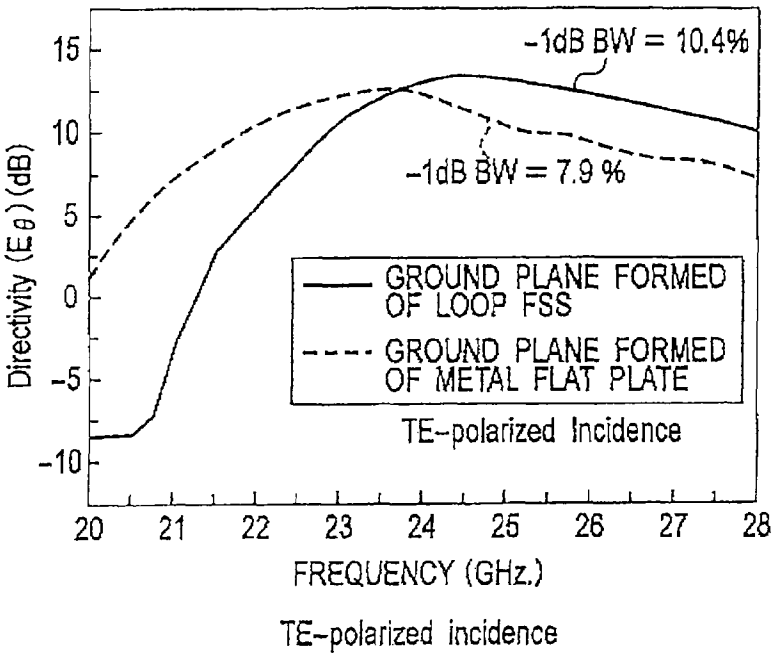

FIG. 14A shows a gain in the 35° direction in the case of the TM wave incidence, and FIG. 14B shows a gain in the 35° direction in the case of the TE wave incidence. In each of FIGS. 14A and 14B, a broken line indicates a gain in the 35° direction in the conventional case where the metal flat plate is used as the ground plane, and a solid line indicates a gain in the 35° direction when the frequency selective square loop according to the present invention is used as the ground plane.

Here, the gain represents the magnitude of the electric field in the main beam direction by comparing magnitudes of radiations in all directions with the average. It can be confirmed from FIGS. 14A and 14B that, when the square loop is used as the ground plane, the level is low at a design frequency of 24 GHz or below and thus the square loop has the frequency selectivity.

Second Embodiment of the Invention

Figure 15B:
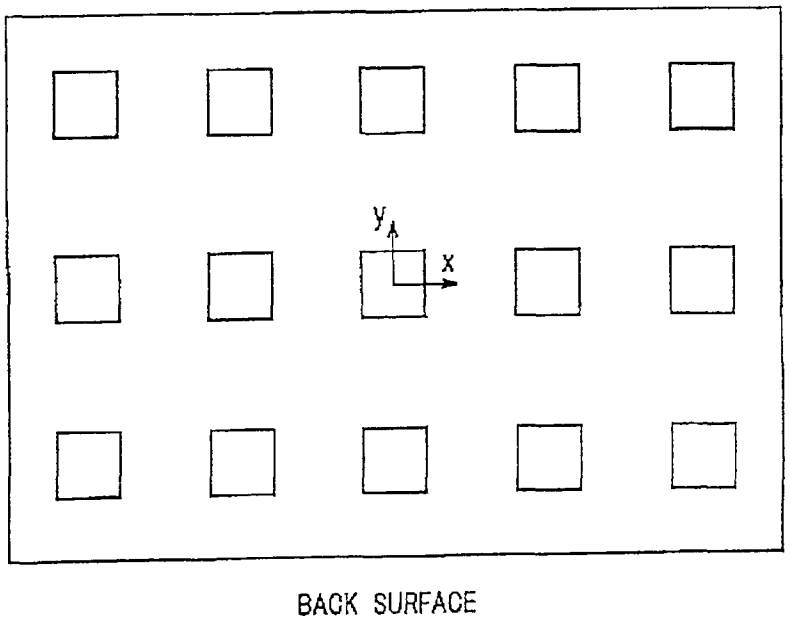
FIGS. 15A and 15B are views showing a reflect array according to a second embodiment of the present invention.
Figure 15A:
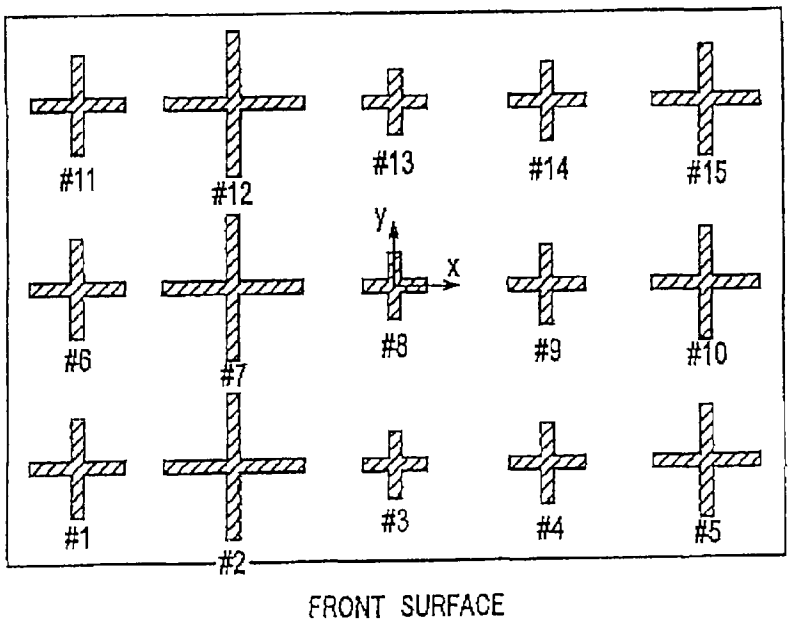

FIGS. 15A and 15B show an example of a reflect array according to a second embodiment of the present invention.

As shown in FIGS. 15A and 15B, the reflect array according to this embodiment is a polarization sharing reflect array including crossed dipoles on its front surface and loops on its back surface. The reflect array according to this embodiment uses crossed dipoles, each having the same length in Y and X directions.

In general specular reflection, when an incident wave is ($\theta_i$, $\Phi_i$)=(0°, 0°), a reflected wave is set to ($\theta_s$, $\Phi_s$)=(0°, 0°).

On the other hand, FIGS. 15A and 15B show an example where the reflect array is designed in such a manner that any polarized wave which is ($\theta_i$, $\Phi_i$)=(0°, 0°), that is, which is incident from a positive direction of Z-axis shown in FIGS. 15A and 15B is reflected to a direction of ($\theta_s$, $\Phi_s$)=(30°, 0°).

An electric field of plane waves exists only on a plane perpendicular to a traveling direction of electric waves. Therefore, the electric field of plane waves has no Z component and an electric field vector can be considered by being separated into an $E_y$ component and an $E_x$ component.

Accordingly, if a wave parallel to the $E_x$ component and a wave parallel to the $E_y$ component are both radiated in the direction of ($\theta_s$, $\Phi_s$)=(30°, 0°), any polarized wave incident from ($\theta_i$, $\Phi_i$)=(0°, 0°) is radiated in a direction of ($\theta_s$, $\Phi_s$)=(−30°, 0°).

To realize the above, the crossed dipoles on the front surface shown in FIG. 15A are set to have the same length in the X and Y directions.

FIG. 16 shows lengths of the crossed dipoles in the reflect array according to this embodiment. Here, the numbers in FIG. 16 correspond to the numbers in FIG. 15A. In the reflect array according to this embodiment, structures in the Y-axis direction are all symmetrical. This is because the beam incident in the Z-axis direction is controlled on an XZ plane.

Figure 17B:
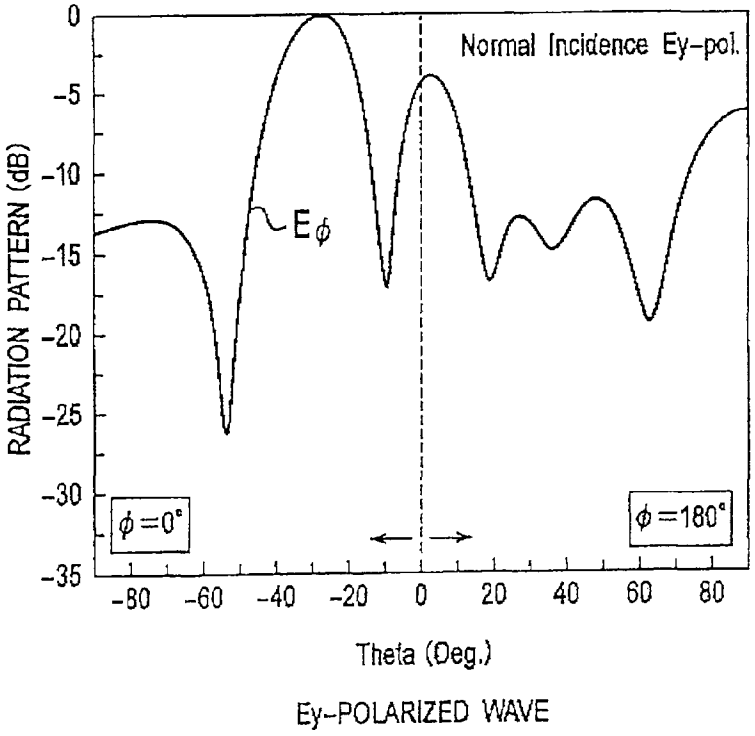
FIGS. 17A and 17B are views showing a radiation pattern of the crossed dipole in the frequency selective reflect array according to the second embodiment of the present invention.
Figure 17A:
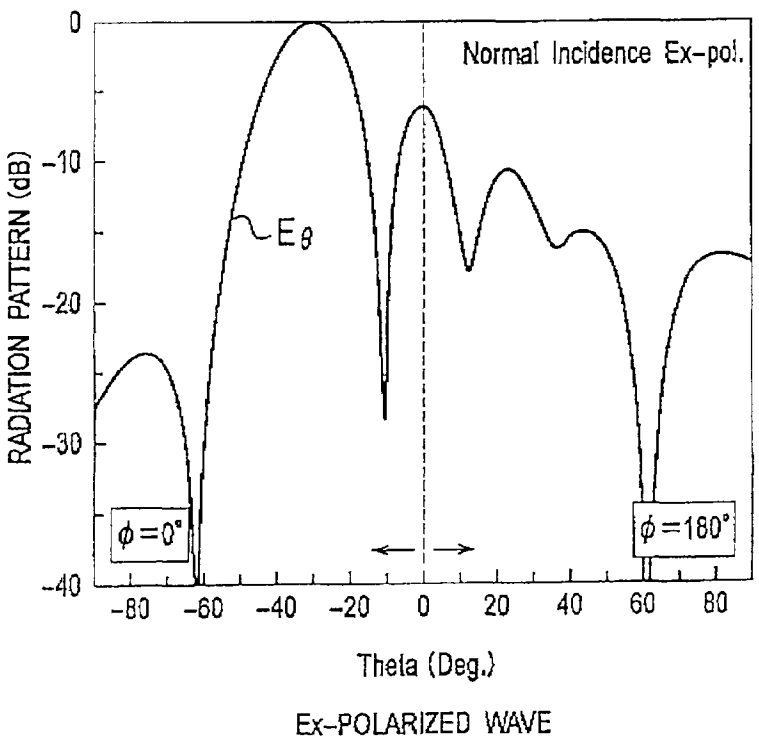

FIGS. 17A and 17B show a far field of the crossed dipole in the reflect array according to this embodiment.

It can be confirmed that the main beam is directed to the desired direction of θ=−30° in both cases of the $E_x$ polarized wave shown in FIG. 17A and the $E_y$ polarized wave shown in FIG. 17*b*. Note that the loops on the back surface have the frequency selectivity as in the case of the reflect array according to the first embodiment of the present invention.

Third Embodiment of the Invention

Figure 18B:
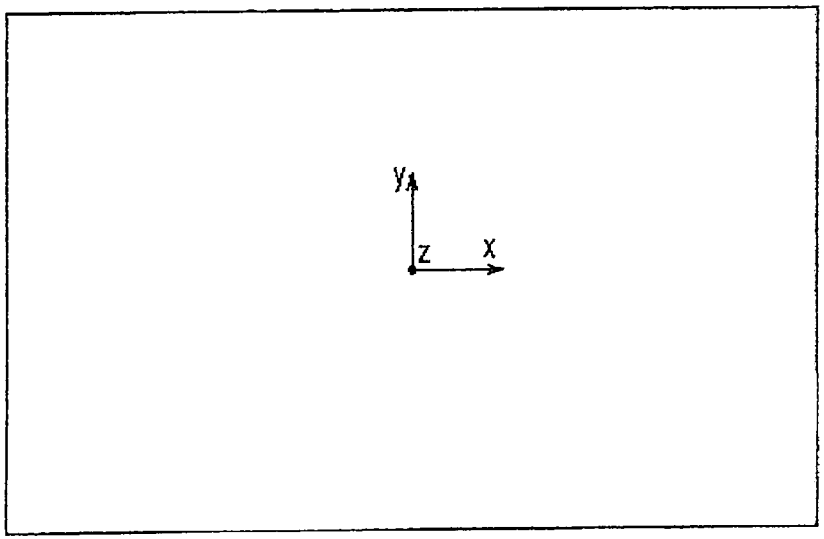
FIGS. 18A and 18B are views showing a reflect array according to a third embodiment of the present invention.
Figure 18A:
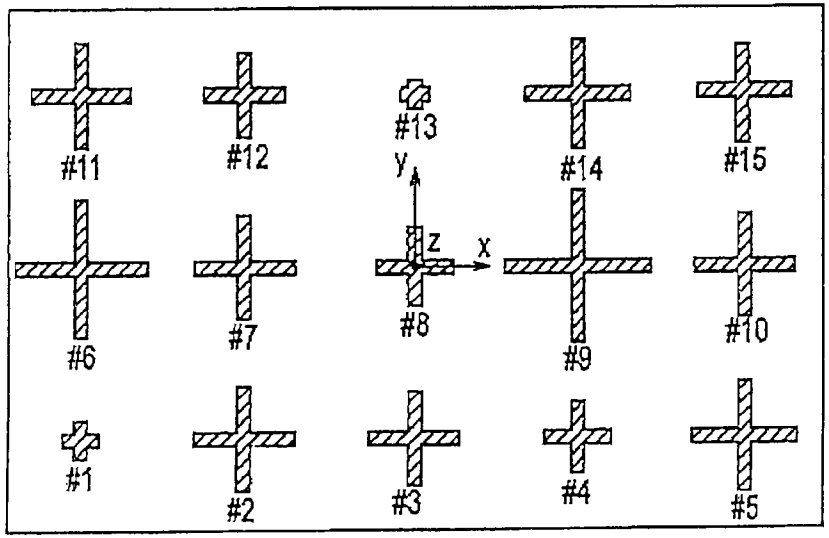

FIGS. 18A and 18B show an example of a reflect array according to a third embodiment of the present invention.

The reflect array according to this embodiment represents an example of bending a reflected wave in a desired direction for any polarized wave on a plane perpendicular to a traveling direction by using metal as a ground plane and crossed dipoles as elements.

FIG. 18A shows a front surface of the reflect array according to this embodiment, and FIG. 18B shows aback surface of the reflect array according to this embodiment.

The front surface of the reflect array according to this embodiment includes the crossed dipoles and the back surface of the reflect array according to this embodiment is formed of a metal flat plate.

In the reflect array according to this embodiment, a direction of an incident wave is set to ($\theta_i$, $\Phi_i$)=(20°, −90°) and a direction of a reflected wave is set to ($\theta_s$, $\Phi_s$)=(35°, 180°) at 24 GHz.

FIG. 19 shows design values of the respective elements in the reflect array according to this embodiment. Moreover, FIGS. 20A and 20B show a far field of the crossed dipoles in the reflect array according to this embodiment.

Figure 20B:
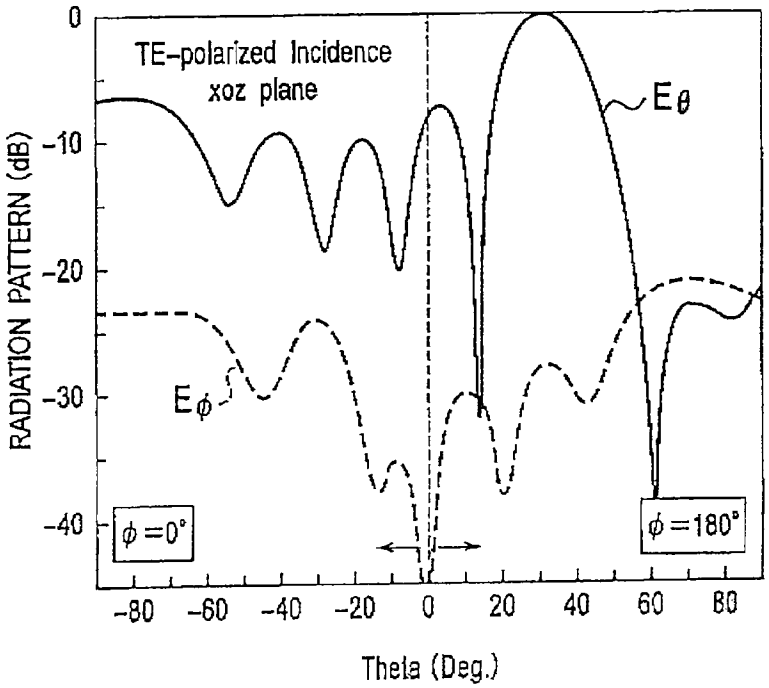
FIGS. 20A and 20B are views showing a radiation pattern of the crossed dipole in the frequency selective reflect array according to the third embodiment of the present invention.
Figure 20A:
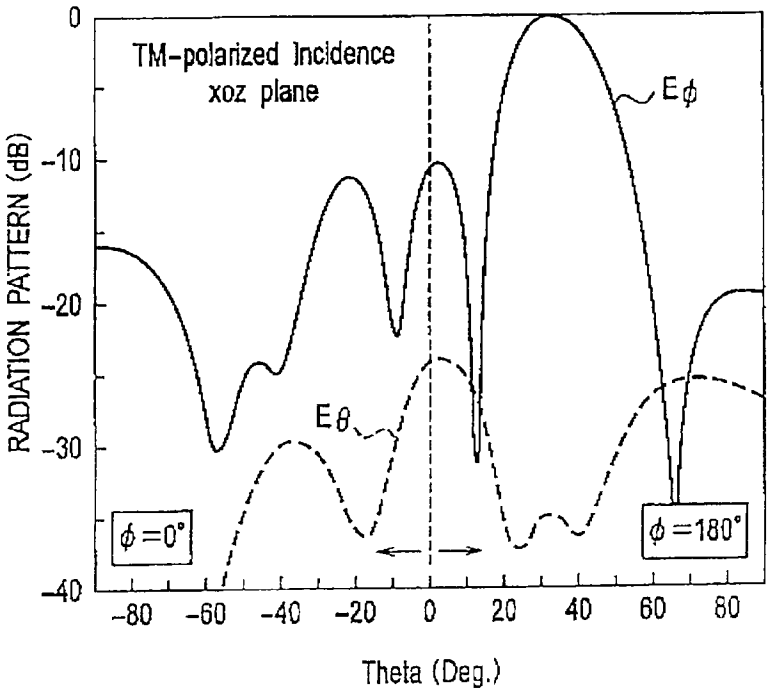

It is clear from FIGS. 20A and 20B that an $E_\Phi$ component in the case of TM wave incidence and an $E_\theta$ component in the case of TE wave incidence are both reflected to a desired 35° direction.

Fourth Embodiment of the Invention

Figure 21:
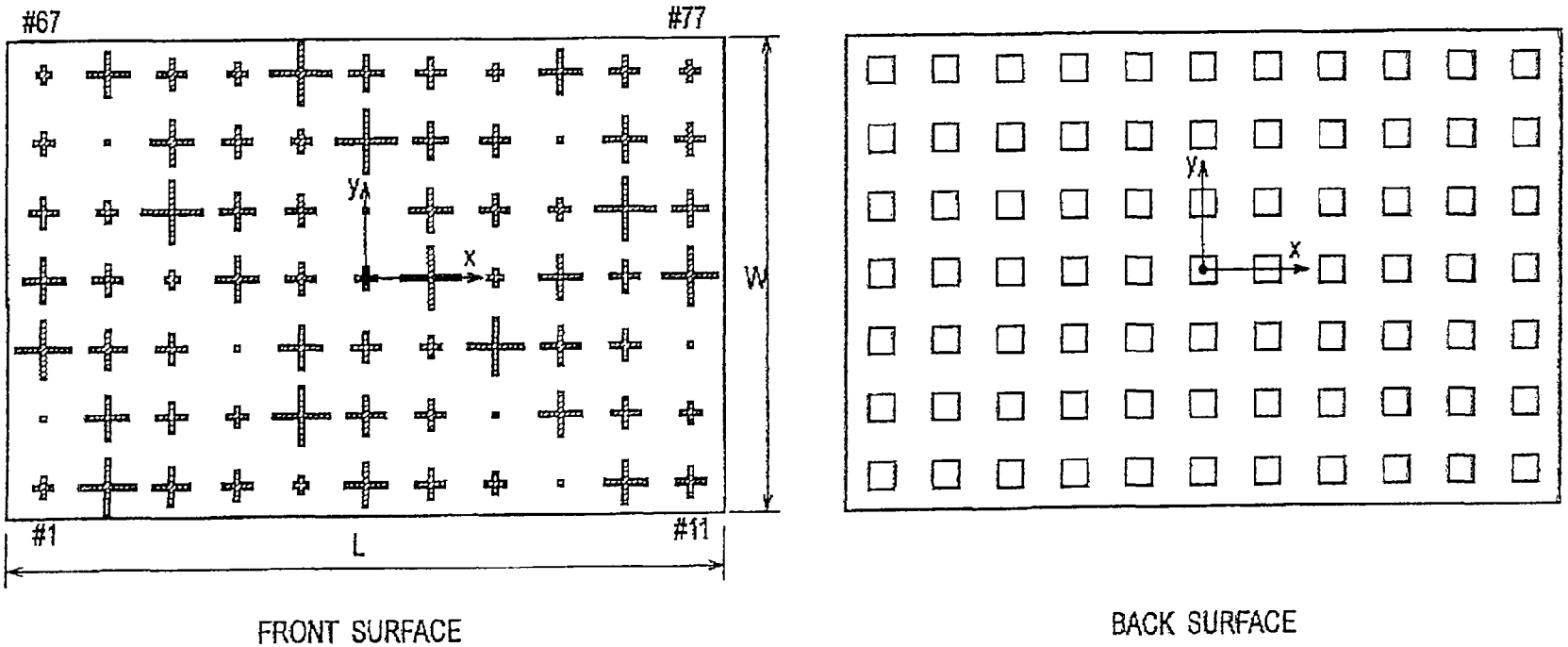
FIG. 21 is a view showing a reflect array according to a fourth embodiment of the present invention.

FIG. 21 shows an example of a reflect array according to a fourth embodiment of the present invention.

FIG. 21 shows an example of the case where the number of elements is increased and a size of a reflector is increased. As to designing of the reflect array, a direction of an incident wave is set to ($\theta_i$, $\Phi_i$)=(20°, −90°) and a direction of a reflected wave is set to ($\theta_s$, $\Phi_s$)=(30°, 180°).

FIG. 22 shows design values of the respective elements in the reflect array according to this embodiment. Moreover, FIGS. 23A and 233 show a far field of the crossed dipoles in the reflect array according to this embodiment.

Figure 23B:
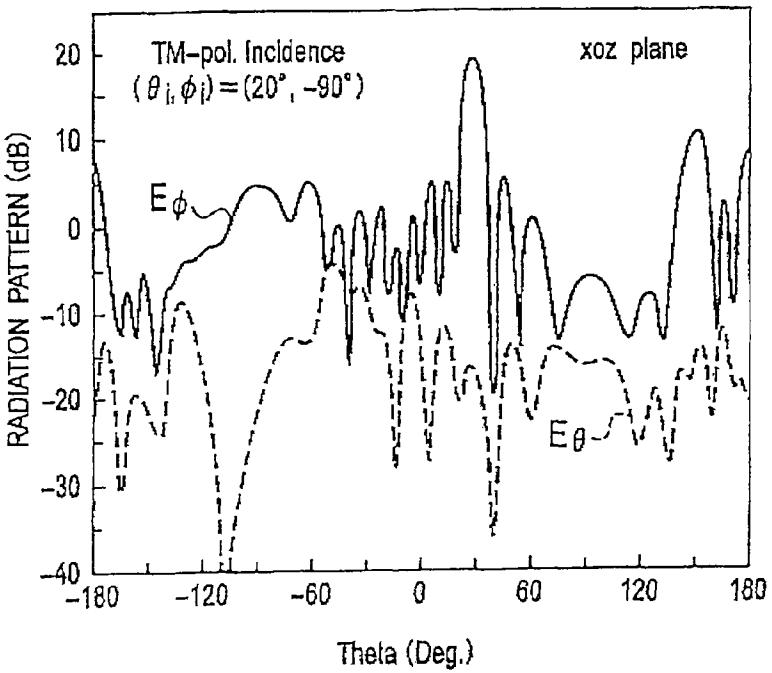
FIGS. 23A and 23B are views showing a radiation pattern of the crossed dipole in the frequency selective reflect array according to the fourth embodiment of the present invention.
Figure 23A:
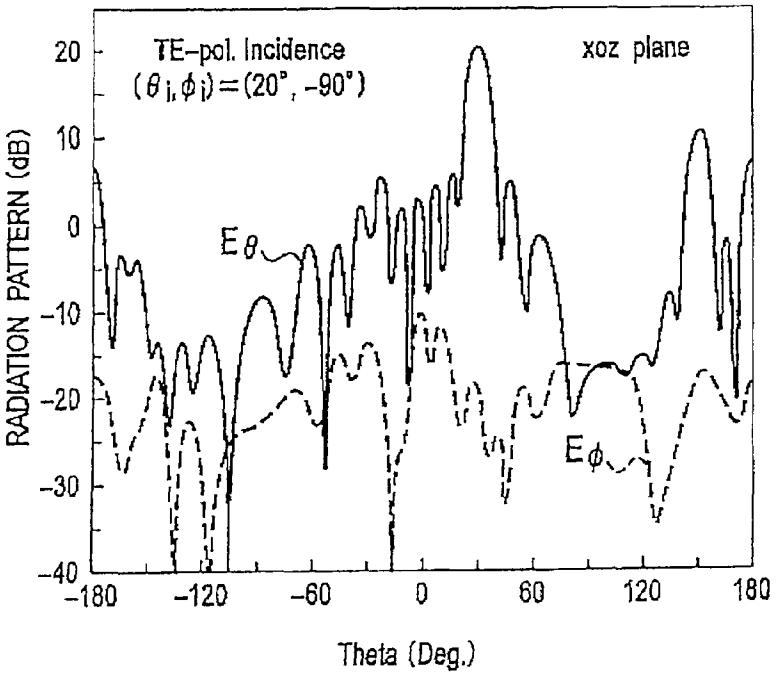

It is clear from FIGS. 23A and 23B that components are reflected to a desired 30° direction in both cases of TM wave incidence and TE wave incidence.

Fifth Embodiment of the Invention

Figures 24, 25:
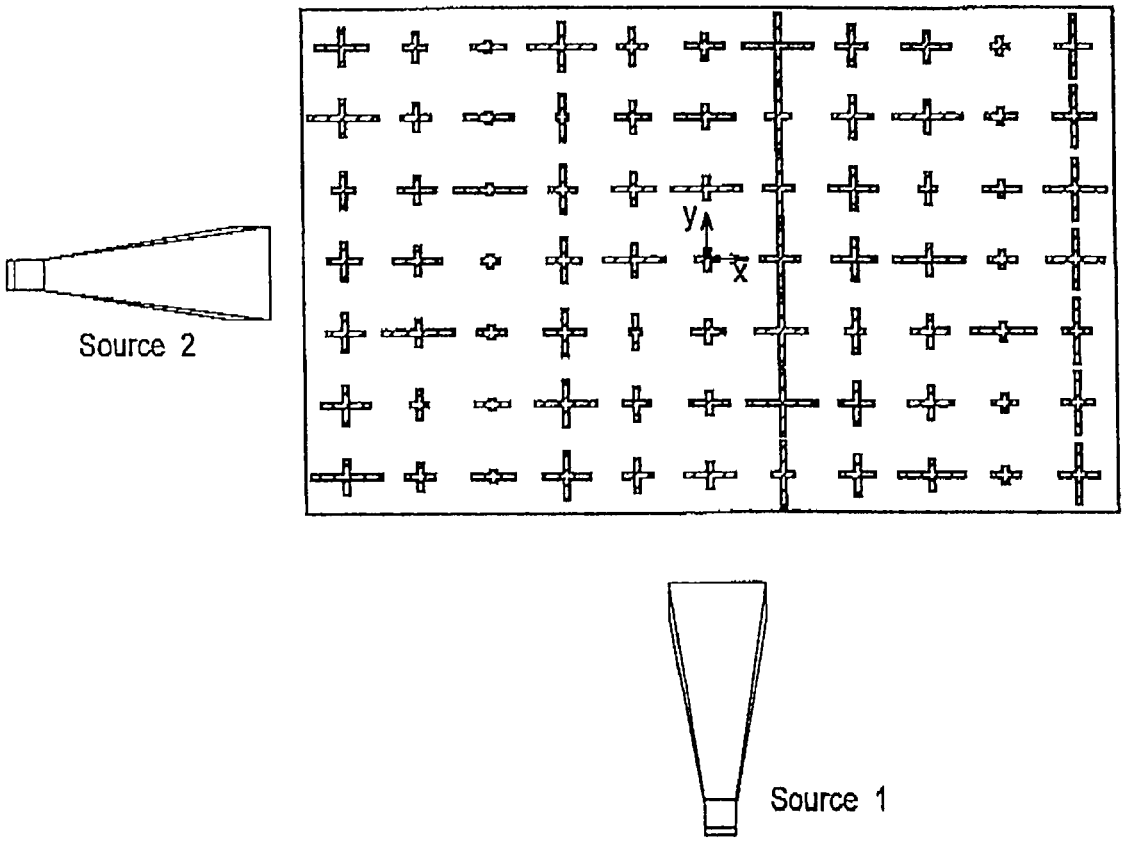
FIG. 24 is a view showing a reflect array according to a fifth embodiment of the present invention.
FIG. 25 is a view showing design conditions in the reflect array according to the fifth embodiment of the present invention.

FIG. 24 shows a structure of a reflect array according to a fifth embodiment of the present invention.

FIG. 24 is atop view, seen from an element side, showing a polarization independent crossed-dipole reflect array according to this embodiment.

Here, as shown in FIG. 24, coordinates are placed by setting planar directions as X and Y axes, and a direction perpendicular thereto is a Z axis.

In this embodiment, design conditions are set as shown in FIG. 25. Specifically, assuming incidence in different directions in such a manner that an incidence angle is set to ($\theta_{i1}$, $\Phi_{i1}$)=(20°, −90°) for a polarized wave in the X-axis direction and an incidence angle is set to ($\theta_{i2}$, $\Phi_{i2}$)=(30°, −180°) for a polarized wave in the Y-axis direction, the reflect array is designed so as to radiate scattered waves in different directions in such a manner that a reflection angle is set to ($\theta_{r1}$, $\Phi_{r1}$)=(40°, 0°) for the polarized wave in the X-axis direction and a reflection angle is set to ($\theta_{r2}$, $\Phi_{r2}$)=(0°, 0°) for the polarized wave in the Y-axis direction.

Figure 26:
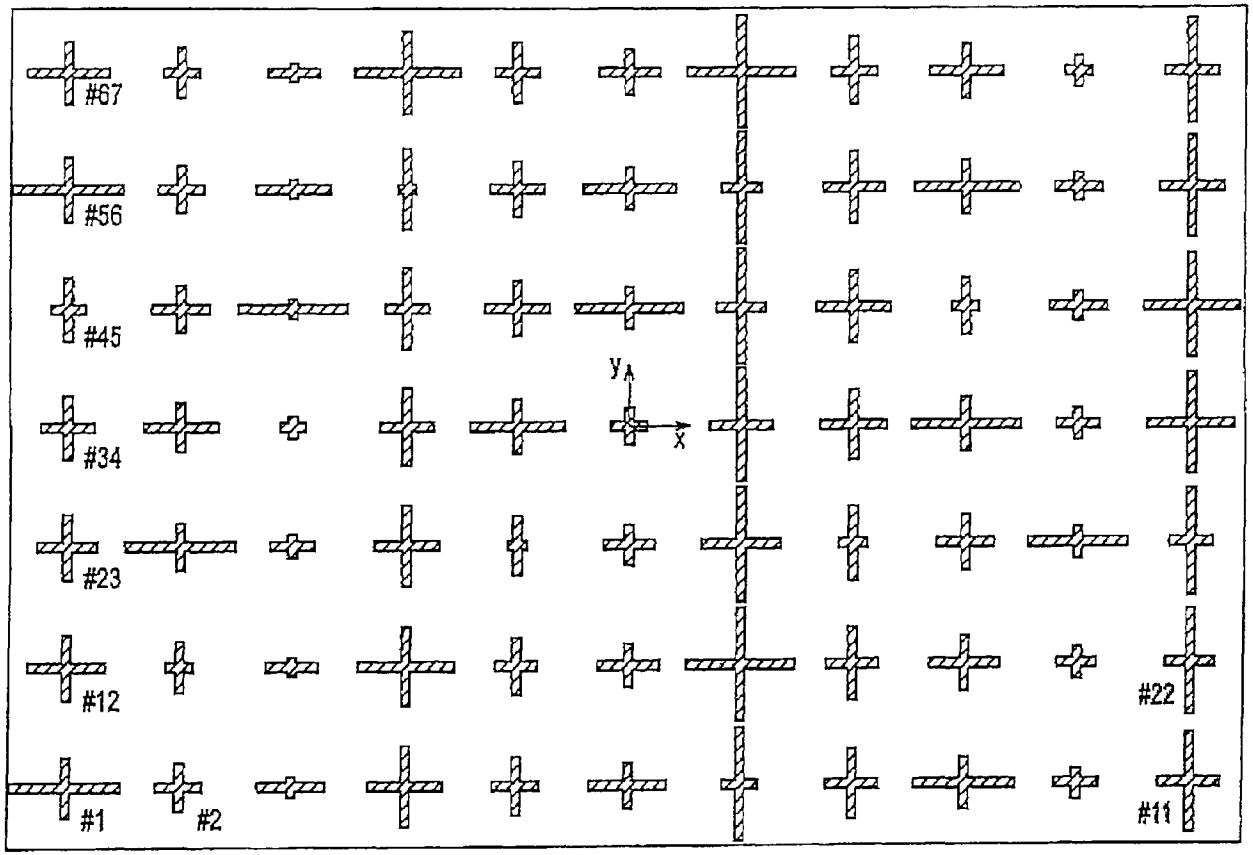
FIG. 26 is a view showing element numbers of the reflect array according to the fifth embodiment of the present invention.

FIG. 26 shows the numbers of elements in the reflect array according to this embodiment. Moreover, FIG. 27 shows a list of lengths of the respective elements.

Next, description will be given of a method for determining X-direction and Y-direction lengths of each of the elements.

Figures 27, 28:
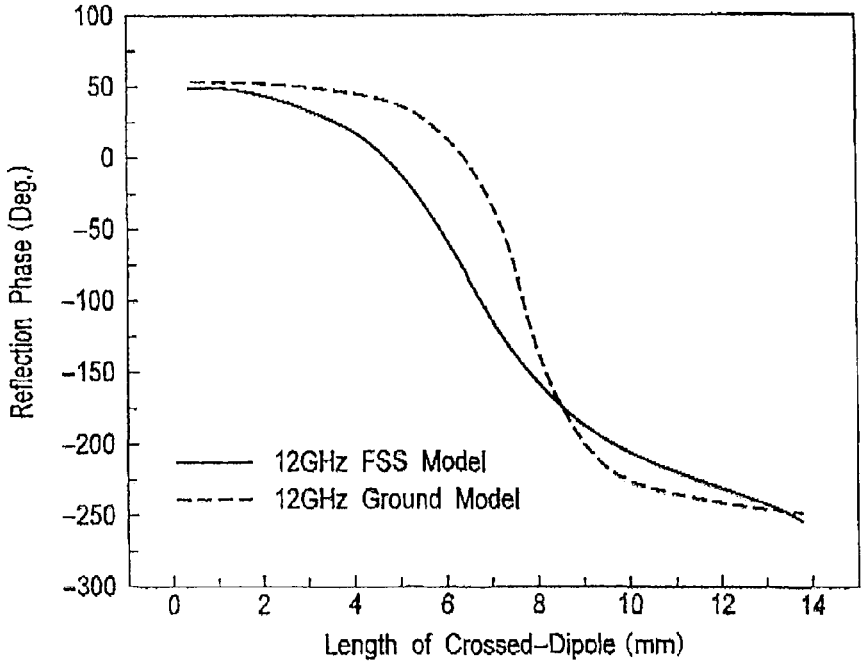
FIG. 27 is a view showing an example of lengths of respective elements of the reflect array according to the fifth embodiment of the present invention.
FIG. 28 is a graph showing a length of a crossed dipole in the horizontal axis and a value of a reflection phase (phase of reflected wave) in the vertical axis in the reflect array according to the fifth embodiment of the present invention.

FIG. 28 is a graph showing a length of a crossed dipole in the horizontal axis and a value of a reflection phase (phase of reflected wave) in the vertical axis.

In FIG. 28, a broken line indicates an example where the ground plane is a metal plate, and a solid line indicates an example where a frequency selective surface is used as the ground plane.

The tilts of the reflection phases in relation to the length are different from each other due to the difference in the ground plane. However, it is clear that, in either case, the value of the reflection phase can be changed from about 50° to −250° by changing the length of the crossed dipole from 0 mm to 14 mm.

Here, the crossed dipole is symmetrical with respect to the both polarized waves in the X-axis and Y-axis directions. Thus, FIG. 28 can be used for the both polarized waves.

Figure 29:
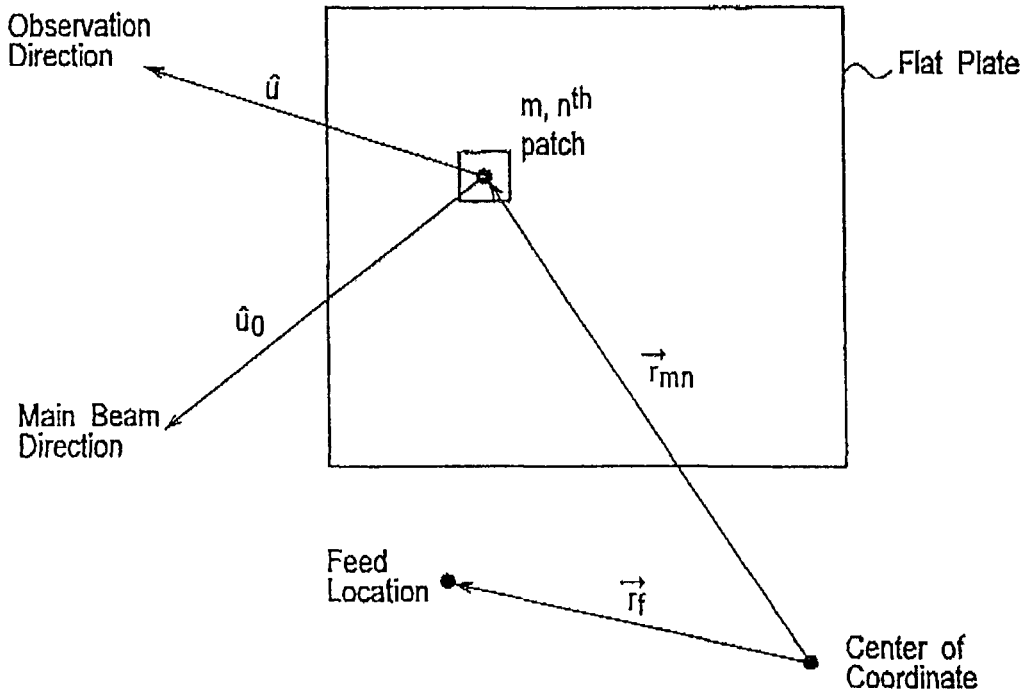
FIG. 29 is a view for explaining design parameters of the reflect array according to the fifth embodiment of the present invention.

According to FIG. 28, based on the array antenna theory, a radiation direction can be controlled by using the reflection phase. Specifically, when parameters are expressed as shown in FIG. 29, a phase $\alpha_{mn}$ of the array element is expressed by the following (Formula 2).

$$\alpha_{mn}-K_0[|\vec{r}_{mn}-\vec{r}_f|+\vec{r}_{mn}\cdot\vec{U}_0]=2N\pi, N=0,1,2 \quad \text{(Equation 2)}$$

The length parameters shown in FIG. 27 are determined when the back surface is formed of the square loop, based on FIG. 28.

Next, characteristics of the designed reflect array will be described.

Figure 30:
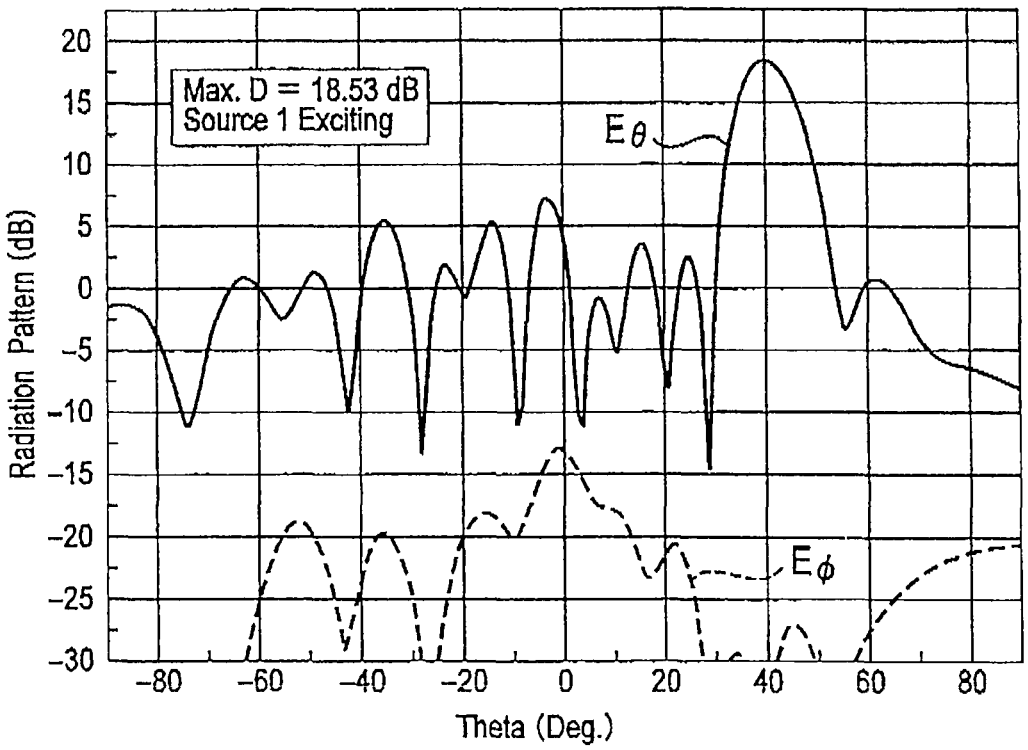
FIG. 30 is a view showing a far scattering field from the reflect array when an X-polarized wave is incident at an angle $(\theta_{i1}, \Phi_{i1})=(20°, -90°)$ in the reflect array according to the fifth embodiment of the present invention.

FIG. 30 shows a far scattering field from the reflect array when an X-polarized wave is incident at an angle $(\theta_{i1}, \Phi_{i1})=(20°, -90°)$.

In FIG. 30, a solid line indicates an $E_\theta$ component of the electric field, and a broken line indicates an $E_\Phi$ component. It is clear that, in a scattered wave in the case of FIG. 30, the $E_\theta$ component is dominant, and the wave is radiated in a desired direction of $(\theta_{r1}, \Phi_{r1})=(40°, 0°)$.

Figure 31:
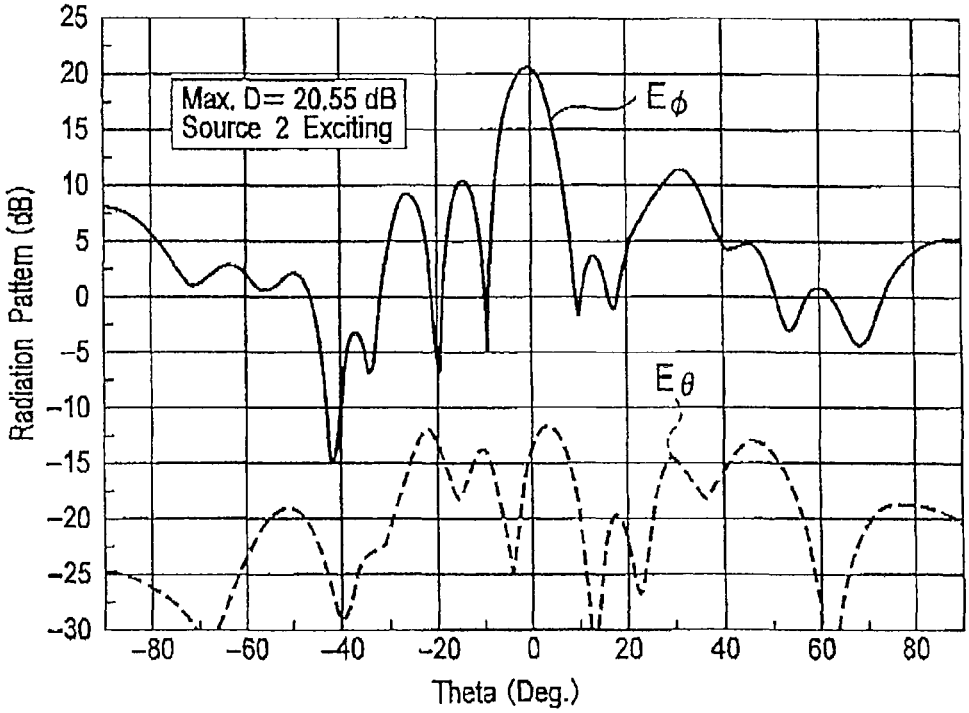
FIG. 31 is a view showing a far scattering field from the reflect array when a Y-polarized wave is incident at an angle $(\theta_{i2}, \Phi_{i2})=(30°, -180°)$ in the reflect array according to the fifth embodiment of the present invention.

Next, FIG. 31 shows a far scattering field from the reflect array when a Y-polarized wave is incident at an angle $(\theta_{i2}, \Phi_{i2})=(30°, -180°)$.

In FIG. 31, a solid line indicates an $E_\Phi$ component of the electric field, and a broken line indicates an $E_\theta$ component thereof. It is clear that, in a scattered wave in the case of FIG. 31, the $E_\Phi$ component is dominant and the wave is radiated in a desired direction of $(\theta_{r2}, \Phi_{r2})=(0°, 0°)$.

As described above, in this embodiment, it is clear that the scattered waves can be controlled to be directed to different independent reflection directions with respect to independent incidence directions for the two polarized waves.

Figure 32:
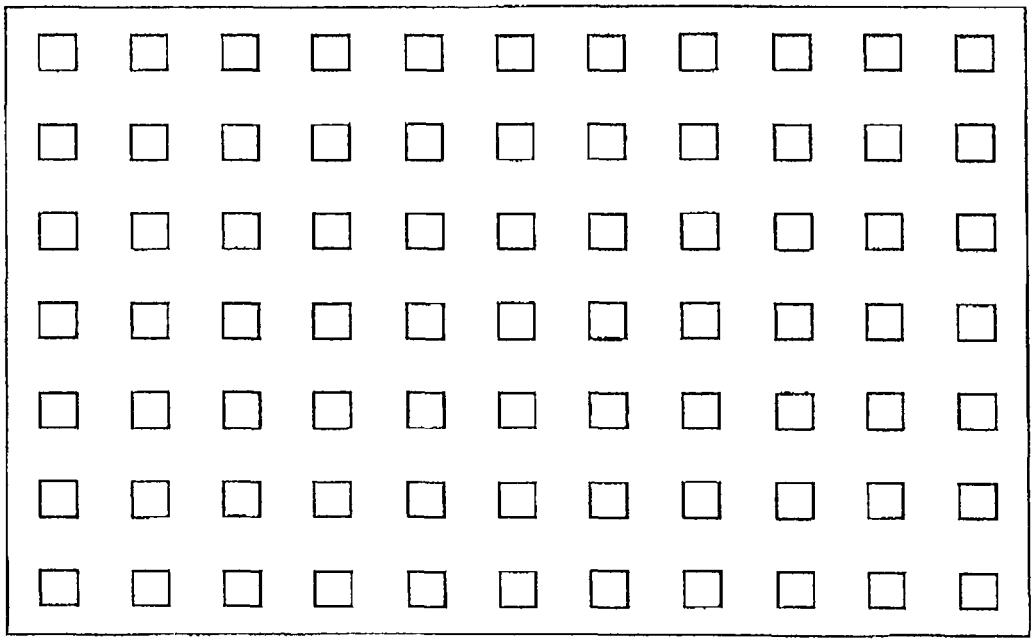
FIG. 32 is a view showing a back surface structure of the reflect array according to the fifth embodiment of the present invention.

FIG. 32 shows a back surface structure of the reflect array according to this embodiment. As shown in FIG. 32, the back surface of the reflect array according to this embodiment is formed of arrays of square loops having a peripheral length of about 1λ.

Figure 33:
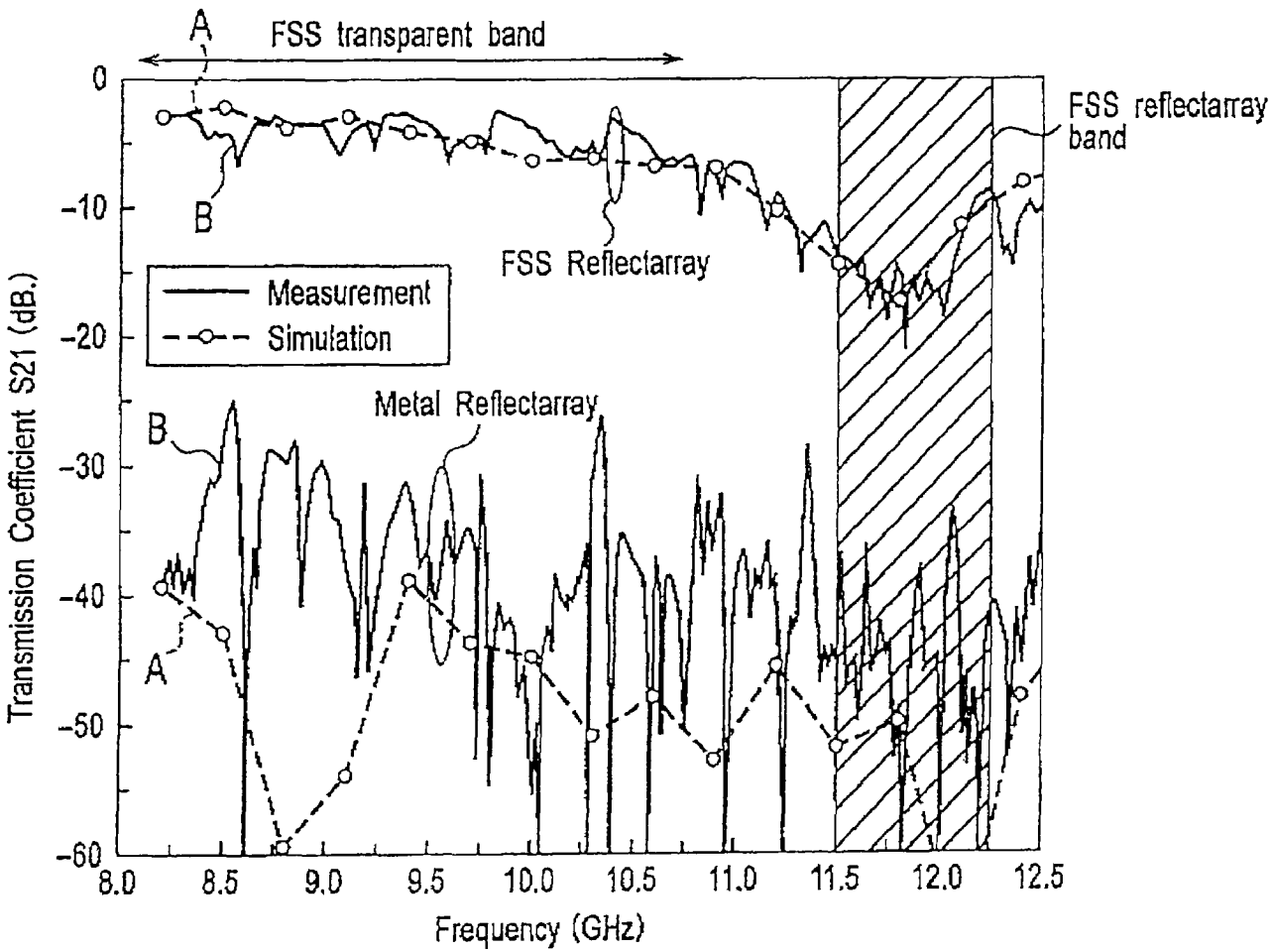
FIG. 33 is a view showing a transmission coefficient in the reflect array according to the fifth embodiment of the present invention.

Next, FIG. 33 shows a transmission coefficient in the reflect array according to this embodiment.

In FIG. 33, frequency characteristics are compared between the transmission coefficient in the reflect array according to this embodiment and a transmission coefficient in a metal reflector. Here, a solid line A indicates a simulation value, and a solid line B indicates a measurement value.

As shown in FIG. 33, while the value of the transmission coefficient is low at any frequency in the case of the metal reflector, the value of the transmission coefficient in the reflect array according to this embodiment is lowered around a design frequency of 12 GHz and is high at other frequencies.

Specifically, it is understood that the reflect array according to this embodiment is more likely to transmit electric waves than the metal reflector in a band other than the usable frequency.

Sixth Embodiment of the Invention

In a reflect array according to a sixth embodiment of the present invention, two element lengths in horizontal and vertical directions can be determined by (Formula 2) while changing the frequency.

Seventh Embodiment of the Invention

With reference to FIGS. 34 to 37, a reflect array according to a seventh embodiment of the present invention will be described.

In the reflect array according to this embodiment, a direction of a scattered wave at a first frequency f1 can be controlled by using elements in the horizontal direction, and a direction of a scattered wave at a second frequency f2 can be controlled by using elements in the vertical direction.

Figure 34:
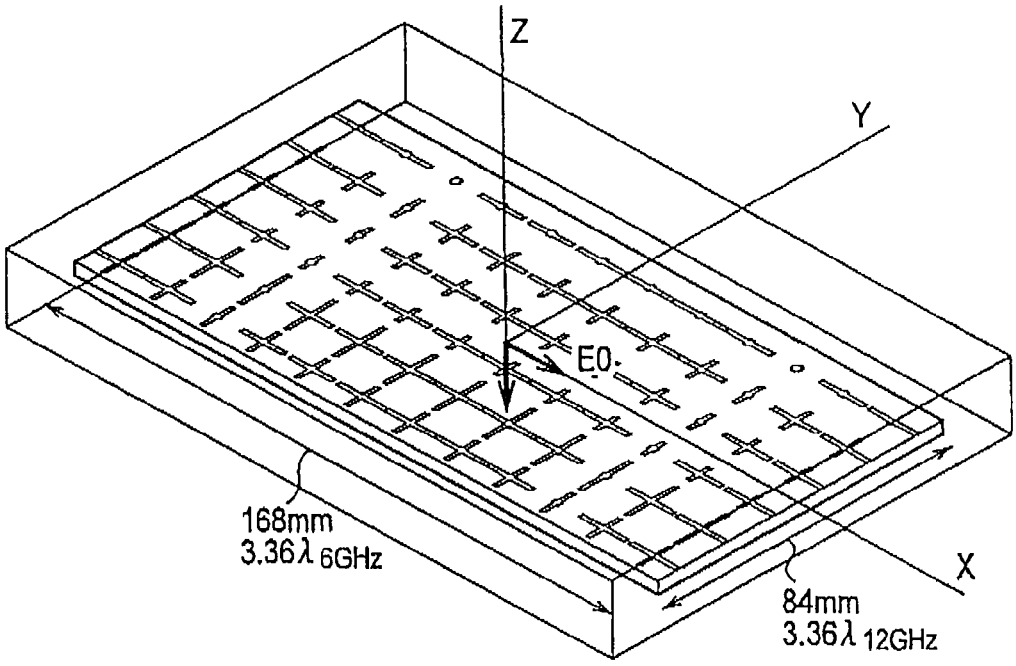
FIG. 34 is a view showing a reflect array according to a seventh embodiment of the present invention.

FIG. 34 shows crossed dipole arrays including 12×6 elements for two-frequency-sharing polarization independent control. Here, horizontal elements are operated for a horizontally polarized incident wave and vertical elements are operated for a vertically polarized incident wave.

Figures 35, 36:
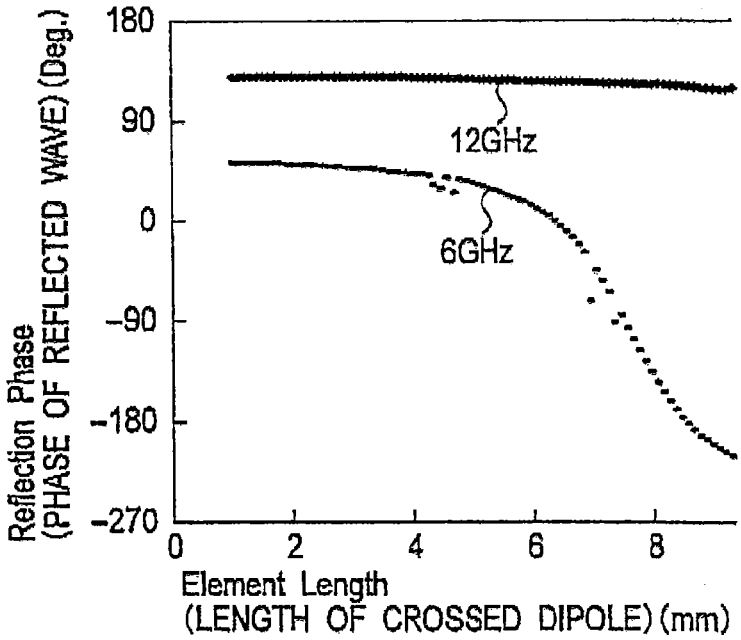
RELATED ART FIG. 36
FIG. 35 is a view showing design conditions in the reflect array according to the seventh embodiment of the present invention.
FIG. 36 is a graph showing a length of a crossed dipole in the horizontal axis and a value of a reflection phase (phase of reflected wave) in the vertical axis in the reflect array according to the seventh embodiment of the present invention.

FIG. 35 shows design conditions of the crossed dipole arrays. An operating frequency is set to 6 GHz in the case of using the horizontal elements and the operating frequency is set to 12 GHz in the case of using the vertical elements. As the design conditions, the reflection direction is steered by 30° on an XZ plane where Φ of spherical coordinates is 0° and constant at 6 GHz, and the reflection direction is steered by 30° on a YZ plane where Φ of spherical coordinates is 90° and constant at 12 GHz.

In order to design the elements of the reflect array which satisfy the above design conditions, a phase of a reflected wave when a plane wave is incident on the crossed dipole arrays having an infinite periodic structure is obtained. In this regard, however, an element interval is set to 14 mm.

FIG. 36 shows relationships between the length of the crossed dipole (element) and the phase at 6 GHz and 12 GHz.

While the phase is changed according to a change in the length of the crossed dipole at 12 GHz, the phase is significantly changed within a narrow range where the length of the crossed dipole is 13 mm to 14 mm at 6 GHz. Thus, it is understood that characteristics of the phase of the reflected wave are different between the two frequencies.

The reflect array shown in FIG. 34 is designed by using the relationship between the length of the crossed dipole and the phase shown in FIG. 36 to obtain dimensions of each element to be a phase difference that satisfies the incidence direction and scattering direction shown in FIG. 35.

Figure 37:
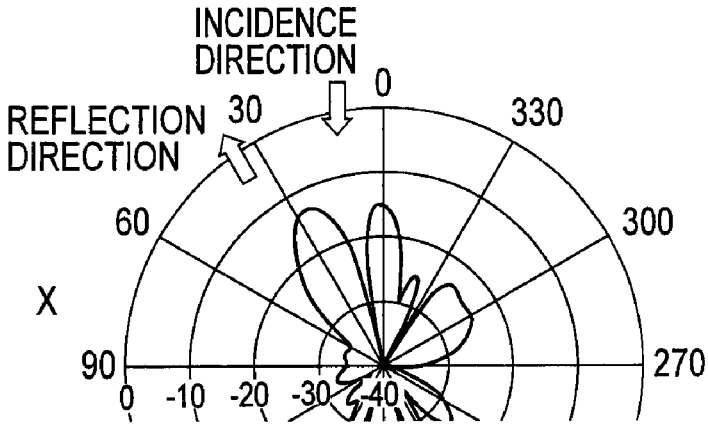
RELATED ART FIG. 37
FIG. 37 is a view showing a far scattering field in the reflect array according to the seventh embodiment of the present invention.
Figure 37:
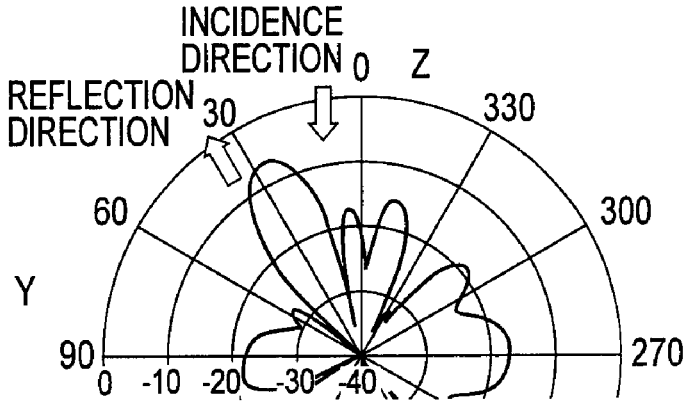
RELATED ART FIG. 37

FIG. 37 shows a far scattering field in the reflect array according to this embodiment. It can be confirmed that, at both two frequencies, beams are radiated at an angle of 30° to X and Y directions from specular reflection.

Although the present invention has been described in detail above by use of the embodiments, it is apparent to those skilled in the art that the present invention is not limited to the embodiments described in the present specification. The present invention can be implemented as altered and modified embodiments without departing from the spirit and scope of the present invention as defined by the description of claims. Therefore, the description of the present specification is for illustrative purposes and is not intended to limit the present invention in any way.

What is claimed is:

1. A reflect array comprising:

a plurality of array elements forming an array configured to control a direction of a reflected wave (scattered wave) by controlling a phase of the reflected wave; and a ground plane, wherein the array elements have a structure for aligning phases for a transverse electric (TE) incident wave and a structure for aligning phases for a transverse magnetic (TM) incident wave, wherein each array element is formed of a crossed dipole having a horizontal rod and a vertical rod;

horizontal and vertical dimensions of the crossed dipole are different for each array element; and for both a TE incident wave and a TM incident wave, any one of the horizontal and vertical rods is operated to control the phase of the reflected wave, thereby controlling the direction of the reflected wave for both of a TE wave and a TM wave simultaneously.

2. A reflect array comprising:

a plurality of array elements forming an array configured to control a direction of a reflected wave (scattered wave) by controlling a phase of the reflected wave; and a ground plane, wherein the ground plane has a structure with a frequency selective function, wherein the frequency selective structure has periodic structure loops.

3. The reflect array according to claim 2, wherein each periodic structure loop has a desired frequency of 1λ; and a pitch between the periodic structure loops is within a range between 0.4λ and 0.6λ.

4. A reflect array comprising:

a plurality of array elements forming an array configured to control a direction of a reflected wave (scattered wave) by controlling a phase of the reflected wave; and a ground plane, wherein the ground plane has a structure with a frequency selective function, wherein the frequency selective structure is configured to reflect (scatter) electric waves at a selective frequency, and to transmit electric waves at frequencies other than the selective frequency.

5. A reflect array comprising:

a plurality of array elements forming an array configured to control a direction of a reflected wave (scattered wave) by controlling a phase of the reflected wave; and a ground plane, wherein the ground plane has a structure with a frequency selective function, wherein the reflect array has a structure which enables the reflected wave to be tilted in a desired direction, by giving a phase difference between X direction and Y direction, for incidence from the X direction and incidence from the Y direction.

6. A reflect array comprising:

a plurality of array elements forming an array configured to control a direction of a reflected wave (scattered wave) by controlling a phase of the reflected wave; and a ground plane, wherein the ground plane has a structure with a frequency selective function, wherein each array element is formed so as to have the same structure and the same size when seen from the horizontal direction and the vertical direction.

7. The reflect array according to claim 6, wherein the ground plane is formed so as to have the same structure and the same size when seen from the horizontal direction and the vertical direction.

8. A reflect array comprising:

a plurality of array elements; and a ground plane, wherein each array element is formed of a crossed dipole having a horizontal rod and a vertical rod; and when an incidence direction of a vertically-polarized wave and an incidence direction of a horizontally-polarized wave are different from each other, the vertical rods are operated for the incidence of the vertically-polarized wave so that a reflected wave (scattered wave) is radiated in a direction determined by a phase of a current distribution of each vertical rod, and the horizontal rods are operated for the incidence of the horizontally-polarized wave so that a reflected wave (scattered wave) is radiated in a direction determined by a phase of a current distribution of each horizontal rod, thereby independently determining a radiation direction of the reflected wave of the vertically-polarized wave and a radiation direction of the reflected wave of the horizontally-polarized wave.

9. The reflect array according to claim 8, wherein an operating frequency of the horizontal rod and an operating frequency of the vertical rod are different from each other.

10. The reflect array according to any one of claims 8 and 9, wherein the ground plane is formed of a frequency selective surface.

11. The reflect array according to claim 10, wherein the frequency selective surface is formed of a loop array.

12. The reflect array according to claim 10, wherein the ground plane is formed of a two-frequency-sharing frequency selective surface.

13. The reflect array according to claim 10, wherein the ground plane is formed of a broadband frequency selective surface.

14. A reflect array comprising:

a plurality of array elements forming an array configured to control a direction of a reflected wave by controlling a phase of the reflected wave (scattered wave) by controlling a phase of the reflected wave; and a ground plane, wherein the array elements are polarization sharing elements and have a function capable of being shared and used for incident waves coming in as both horizontally-polarized and vertically-polarized waves, each array element is formed of a crossed dipole having a horizontal rod and a vertical rod, horizontal and vertical dimensions of the crossed dipole are different for each array element, and for both a transverse electric (TE) incident wave and a transverse magnetic (TM) incident wave, any one of the horizontal and vertical rods is operated to control the phase of the reflected wave, thereby controlling the direction of the reflected wave for both of a TE wave and a TM wave simultaneously.

15. A reflect array comprising:

a plurality of array elements forming an array configured to control a direction of a reflected wave (scattered wave) by controlling a phase of the reflected wave; and a ground plane, wherein the array elements have a structure for aligning phases for a transverse electric (TE) incident wave and a structure for aligning phases for a transverse magnetic (TM) incident wave, and the array has a structure which enables the reflected wave to be tilted in a desired direction, by giving a phase difference between X direction and Y direction, for incidence from the X direction and incidence from the Y direction.

16. A reflect array comprising:

a plurality of array elements forming an array configured to control a direction of a reflected wave by controlling a phase of the reflected wave (scattered wave) by controlling a phase of the reflected wave; and a ground plane, wherein the array elements are polarization sharing elements and have a function capable of being shared and used for incident waves coming in as both horizontally-polarized and vertically-polarized waves, and the array has a structure which enables the reflected wave to be tilted in a desired direction, by giving a phase difference between X direction and Y direction, for incidence from the X direction and incidence from the Y direction.

17. A reflect array comprising:

a plurality of array elements forming an array configured to control a direction of a reflected wave (scattered wave) by controlling a phase of the reflected wave; and a ground plane, wherein the array elements have a structure for aligning phases for a transverse electric (TE) incident wave and a structure for aligning phases for a transverse magnetic (TM) incident wave, and each array element is formed so as to have the same structure and the same size when seen from the horizontal direction and the vertical direction.

18. A reflect array comprising:

a plurality of array elements forming an array configured to control a direction of a reflected wave by controlling a phase of the reflected wave (scattered wave) by controlling a phase of the reflected wave; and a ground plane, wherein the array elements are polarization sharing elements and have a function capable of being shared and used for incident waves coming in as both horizontally-polarized and vertically-polarized waves, and each array element is formed so as to have the same structure and the same size when seen from the horizontal direction and the vertical direction.

* * * * *